US012264479B2

(12) United States Patent
Mrkalj

(10) Patent No.: US 12,264,479 B2
(45) Date of Patent: Apr. 1, 2025

(54) MODULAR PANELS, SYSTEMS, AND METHODS OF ASSEMBLY

(71) Applicant: ACM Panelworx Inc., Lakeshore (CA)

(72) Inventor: Mark Mrkalj, Tecumseh (CA)

(73) Assignee: ACM Panelworx Inc., Lakeshore (CA)

( * ) Notice: Subject to any disclaimer, the term of this patent is extended or adjusted under 35 U.S.C. 154(b) by 330 days.

(21) Appl. No.: 17/542,901

(22) Filed: Dec. 6, 2021

(65) Prior Publication Data

US 2022/0178148 A1 Jun. 9, 2022

Related U.S. Application Data

(60) Provisional application No. 63/122,038, filed on Dec. 7, 2020.

(51) Int. Cl.
*E04F 13/08* (2006.01)
*E04F 13/12* (2006.01)

(52) U.S. Cl.
CPC ..... *E04F 13/0805* (2013.01); *E04F 13/12* (2013.01)

(58) Field of Classification Search
CPC ... E04F 13/0805; E04F 13/12; E04F 13/0803; E04F 13/0894; E04F 13/083; E04F 13/08; E04F 13/0821; E04D 1/2918; E04D 1/2921; E04D 1/2928; E04D 1/2935; E04D 1/2949; E04D 1/2956; E04D 1/2984; E04D 3/365; E04D 3/368; E04D 1/2916; E04D 1/2914; E04D 1/2942; E04D 3/362
USPC ..... 52/525, 529, 530, 531, 533, 535, 538, 52/539
See application file for complete search history.

(56) References Cited

U.S. PATENT DOCUMENTS 359,959 A * 3/1887 Cortright ..... E04D 1/2942 52/531
951,307 A * 3/1910 Ebner ..... E04B 9/0435 52/530
973,946 A * 10/1910 Lindau ..... E04D 1/2918 52/553
978,834 A * 12/1910 Bonness ..... E04D 3/362 52/404.3
1,688,612 A * 10/1928 Clow ..... E04D 1/2918 52/525

(Continued)

FOREIGN PATENT DOCUMENTS

GB 2436572 A 10/2007

OTHER PUBLICATIONS

Panel material. Photograph was taken prior to Dec. 7, 2020. Canada.

*Primary Examiner* — Paola Agudelo
*Assistant Examiner* — Adam G Barlow
(74) *Attorney, Agent, or Firm* — Heer Law; Stephano Salani

(57) ABSTRACT

A panel and panel system for wall cladding is disclosed. The panel comprises an exterior face; and a reveal face, comprising: a top reveal plane extending at a top edge of the exterior face; and a side reveal plane extending at a side edge of the exterior face, the side reveal plane having a top alignment tab at a top end of the side reveal plane and a bottom alignment tab at a bottom end of the side reveal plane, the exterior face elevated from the reveal face. The panel further comprises a top protrusion extending from the top reveal plane; and a bottom protrusion extending at a bottom edge of the exterior face.

9 Claims, 42 Drawing Sheets

(56) References Cited

U.S. PATENT DOCUMENTS 1,918,228 A * 7/1933 Spencer ..... E04F 13/12 52/391
3,395,508 A * 8/1968 Blau ..... E04F 10/08 D25/48.8
3,640,044 A * 2/1972 Watts ..... E04D 1/265 D25/139
5,212,914 A * 5/1993 Martin ..... E04F 13/12 52/235
5,305,570 A * 4/1994 Rodriguez ..... E04D 1/2916 52/520
5,338,369 A * 8/1994 Rawlings ..... F24S 20/67 136/246
5,537,792 A * 7/1996 Moliere ..... E04F 13/0864 52/546
6,694,694 B2 * 2/2004 Zeeff ..... E04C 2/08 52/510
6,883,290 B2 * 4/2005 Dinwoodie ..... F24S 25/67 136/246
7,178,295 B2 * 2/2007 Dinwoodie ..... H02S 20/23 136/246
7,207,145 B2 * 4/2007 Stucky ..... E04F 13/0864 52/542
7,240,461 B1 * 7/2007 Vandeman ..... E04F 13/0864 52/557
7,698,864 B2 * 4/2010 Justice ..... E04F 13/185 52/529
D637,314 S * 5/2011 Zeeff ..... D25/138
7,980,037 B2 * 7/2011 Trabue ..... E04D 1/265 52/302.1
8,800,231 B2 * 8/2014 Wagner ..... E04C 2/38 52/537
9,915,063 B1 * 3/2018 Delfino ..... E04F 13/0894
10,865,569 B1 * 12/2020 Bilge ..... E04F 19/061
11,035,128 B2 * 6/2021 Steffes ..... E04F 13/0894
11,293,188 B2 * 4/2022 Henry ..... E04F 13/0894
11,313,135 B1 * 4/2022 Kenny ..... E04F 13/12
11,702,838 B2 * 7/2023 Kralic ..... E04D 3/365 52/783.19
2003/0154680 A1 * 8/2003 Dinwoodie ..... H02S 20/23 52/519
2005/0257477 A1 * 11/2005 Beetler ..... E04D 1/2916 52/553
2006/0144002 A1 * 7/2006 Charlwood ..... E04F 13/12 52/529
2007/0011966 A1 * 1/2007 Justice ..... E04F 13/185 52/309.1
2010/0186334 A1 * 7/2010 Seem ..... E04D 1/2942 52/311.1
2012/0247049 A1 * 10/2012 Wagner ..... E04F 13/0801 264/177.17
2013/0255174 A1 * 10/2013 Stafford ..... E04F 15/02038 52/519
2014/0245681 A1 * 9/2014 Carrubba ..... E04F 13/0894 52/404.4
2014/0345108 A1 * 11/2014 Wagner ..... E04F 13/0889 29/428
2015/0167315 A1 * 6/2015 Steffes ..... E04F 13/0864 52/314
2015/0233124 A1 * 8/2015 Carrubba ..... E04F 13/0826 52/588.1
2019/0301174 A1 * 10/2019 Schultz ..... E04F 13/0864
2020/0308846 A1 * 10/2020 Josefsson ..... E04F 13/076
2021/0087825 A1 * 3/2021 Jang ..... E04F 13/0885
2021/0087829 A1 * 3/2021 Ylikangas ..... B27M 3/0066
2021/0207383 A1 * 7/2021 Henry ..... E04F 13/0894
2022/0112728 A1 * 4/2022 Perra ..... E04F 15/102
2022/0120091 A1 * 4/2022 Letham ..... E04F 13/12
2022/0136256 A1 * 5/2022 Perra ..... E04F 15/02038 52/588.1
2022/0298802 A1 * 9/2022 Ylikangas ..... E04F 13/0894
2022/0381040 A1 * 12/2022 Colyn ..... B29C 48/07
2023/0120445 A1 * 4/2023 Clark ..... B29C 48/002 52/316
2023/0183987 A1 * 6/2023 De Rick ..... E04F 15/02038 52/582.2
2023/0399858 A1 * 12/2023 Boucké ..... E04F 13/14

* cited by examiner

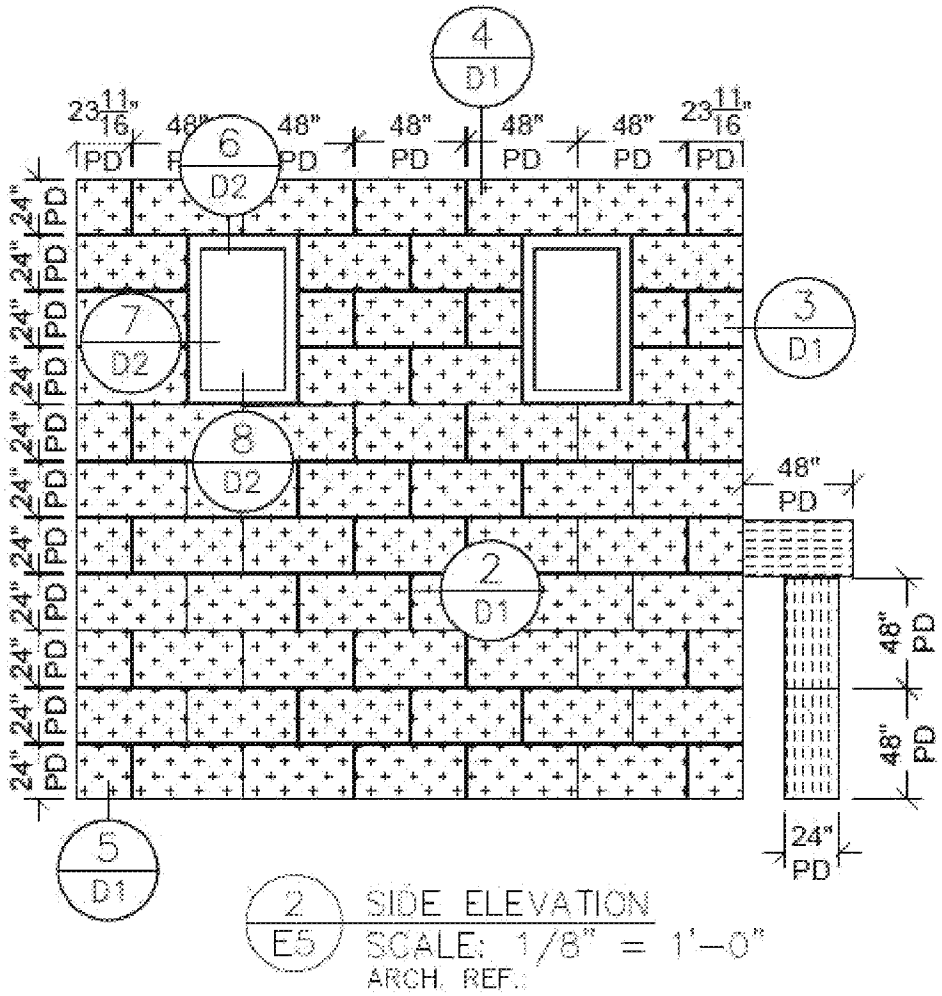
23 11/16"
PD
48"
PD
48"
PD
48"
PD
48"
PD
48"
PD
48"
PD
23 11/16"
PD
24"
PD
24"
PD
24

1 / D1 TYPICAL TERMINATION
SCALE: 3"=1'-0"
ARCH. REF.:

3 / D1 CORNER DETAIL
SCALE: 3"=1'-0"
ARCH. REF.:

7 / D2 JAMB DETAIL AT WINDOW
SCALE: 3"=1'-0"
ARCH. REF.:

MODULAR PANELS, SYSTEMS, AND METHODS OF ASSEMBLY

FIELD

The present disclosure generally relates to the field of construction, and, in particular, to modular panel systems, including modular metal panel systems.

BACKGROUND

Commercial and residential building envelopes are subject to the elements, including weather and precipitation. Precipitation can damage the building envelope or other parts of the building if not properly managed. Multiple devices may be required to assemble components of an exterior facing portion of the building envelope. Exterior facing portions of these building envelopes are also readily visible to onlookers.

SUMMARY

In accordance with an aspect, a panel includes an exterior face and a reveal face. The reveal face includes a top reveal plane extending at a top edge of the exterior face; and a side reveal plane extending at a side edge of the exterior face, the side reveal plane having a top alignment tab at a top end of the side reveal plane and a bottom alignment tab at a bottom end of the side reveal plane. The exterior face is elevated from the reveal face. The panel further includes a top protrusion extending from the top reveal plane; and a bottom protrusion extending at a bottom edge of the exterior face.

According to some embodiments, the top alignment tab extends beyond an axis defined by the top edge of the exterior face and the bottom alignment tab extending toward an axis defined by the bottom edge of the exterior face.

According to some embodiments, the top alignment tab abuts a bottom portion of the top reveal plane.

According to some embodiments, the top protrusion extends from the top reveal plane at an angle toward the exterior face, the top protrusion connected to the top reveal plane along a portion of a top edge of the top reveal plane.

According to some embodiments, the bottom protrusion is an interior lip extending behind the exterior face.

According to some embodiments, the top protrusion extends orthogonally from the top reveal plane toward a first plane defined by the exterior face and then extending along a second plane, the second plane parallel to the top reveal plane.

According to some embodiments, the bottom protrusion extends orthogonally away from the exterior face, then extending along a third plane, the third plane parallel to the first plane, and then extending at a less than 90 degree angle toward the first plane.

According to some embodiments, the top protrusion is a hook-shape complementary to the bottom protrusion for engagement with the bottom protrusion of a second panel and support of the second panel at the bottom protrusion of the second panel.

In accordance with an aspect, a panel system includes a first panel connected to a second panel at an interlocking assembly, a first exterior face of the first panel spaced from a second exterior face of the second panel and from a third exterior face of a third panel.

According to some embodiments, the first panel has an alignment tab abutting a portion of a third panel.

According to some embodiments, the alignment tab abuts the third panel at a top reveal plane, the top reveal plane extending at a top edge of the third exterior face, and the alignment tab abutting a second alignment tab of a side reveal plane of the second panel, the side reveal plane extending at a side edge of the second panel.

According to some embodiments, the second panel is supportable at a wall by the first panel without using an accessory.

According to some embodiments, the spacing is at a reveal face, the reveal face flush between the first exterior face and second exterior face and the third exterior face.

According to some embodiments, the interlocking assembly is a bottom protrusion extending at a bottom edge of the first panel behind the first panel; and a top protrusion extending at a top edge of the second panel at an angle toward the second exterior face.

According to some embodiments, the interlocking assembly includes a first bottom protrusion; and a top protrusion being hook-shaped and complementary to the first bottom protrusion for engagement with a second bottom protrusion of a second panel and support of the first panel at the bottom protrusion of the first panel.

In accordance with an aspect, a method for assembly of a panel system includes abutting an alignment tab of a first panel with a reveal plane of a second panel; and interlocking the first panel with a third panel at an interlocking assembly.

According to some embodiments, the interlocking further includes supporting the third panel by hooking a top portion of the third panel with a bottom portion of the first panel.

According to some embodiments, the hooking further includes mechanically impeding movement of the third panel away from the first panel in at least one direction.

According to some embodiments, the method further includes directing water drainage over the reveal plane of the second panel or over a reveal plane between the first panel and the third panel.

According to some embodiments, the method further includes interlocking a fourth panel with the second panel at a second interlocking assembly.

Other aspects and features and combinations thereof concerning embodiments described herein will be become apparent to those ordinarily skilled in the art upon review of the instant disclosure of embodiments in conjunction with the accompanying figures.

DESCRIPTION OF THE DRAWINGS

Reference will now be made to the accompanying drawings which show, by way of example only, embodiments of the disclosure, and how they may be carried into effect, and in which:

FIG. 12B is a schematic diagram showing a front elevation view of an installation of a panel system, according to some embodiments;

DETAILED DESCRIPTION

Embodiments described herein provide a modular panel system such as for wall cladding that can facilitate water management, provide improved aesthetics, facilitate proper alignment between panels in the panel system, and allow for the assembled panel system to only include the component panels without additional devices or accessories. In some embodiments, the modular panel system can be used for wall cladding or a building envelope, such as in a pressure equalized rainscreen (P.E.R.) design.

Figure 1:
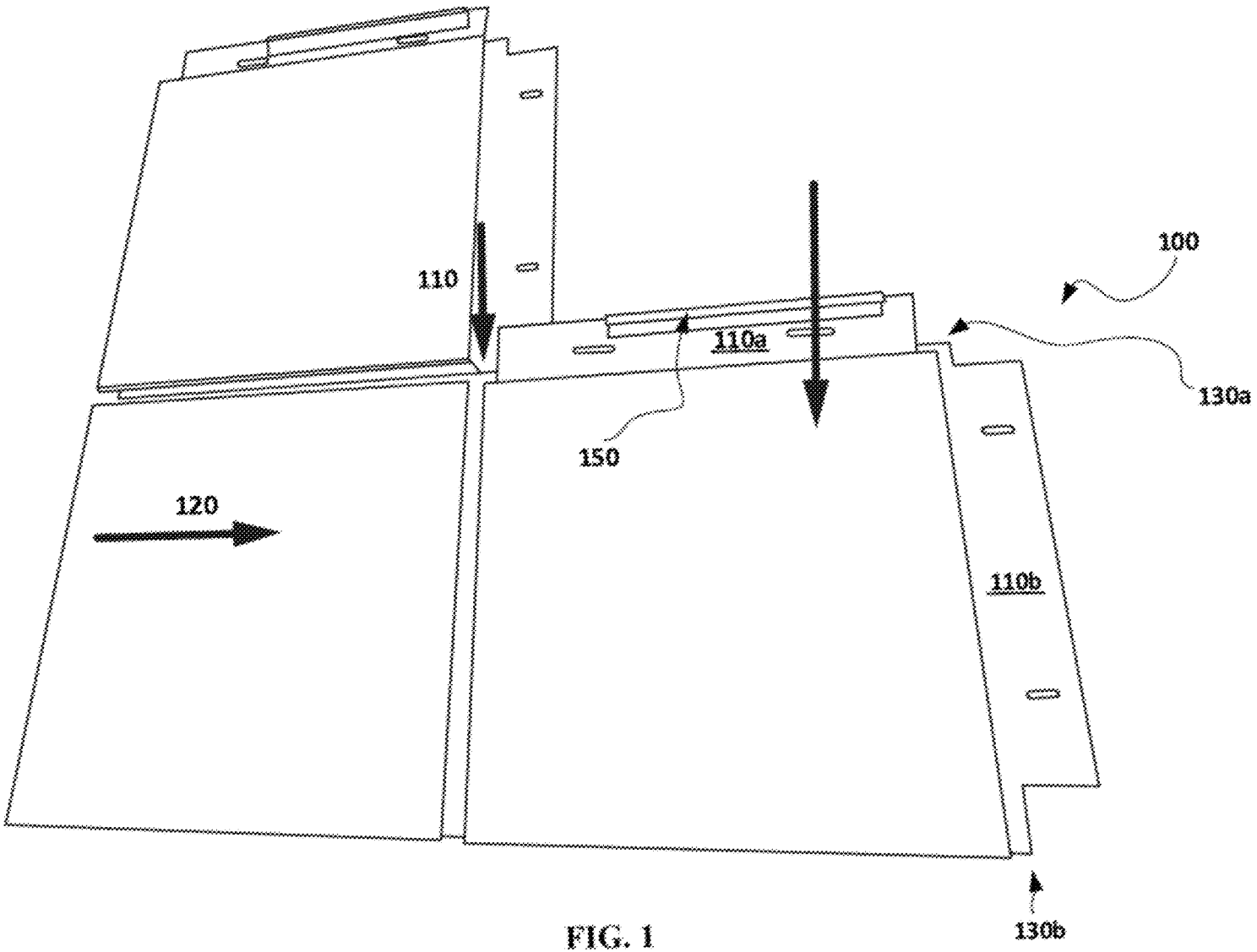
FIG. 1 is a schematic view of a panel system, according to some embodiments.

FIG. 1 is a diagram showing three assembled panels 100 according to some embodiments. As shown, each panel 100, at a front view, has an exterior face 120 and a reveal face comprising reveal planes 110. The exterior face 120 is defined along a top edge, bottom edge, and side edges, such as left side edge and right side edge as shown. The exterior face 120 defines a plane that is a distance away from a plane defined along the reveal face 110. Each reveal plane 110 is connected to the exterior face 120 at a connecting portion extending between the respective planes defined by the reveal plane 110 and the exterior face 120. For example, the connecting portion can be a portion extending orthogonally to the reveal plane 110 and the exterior face 120.

Figure 3:
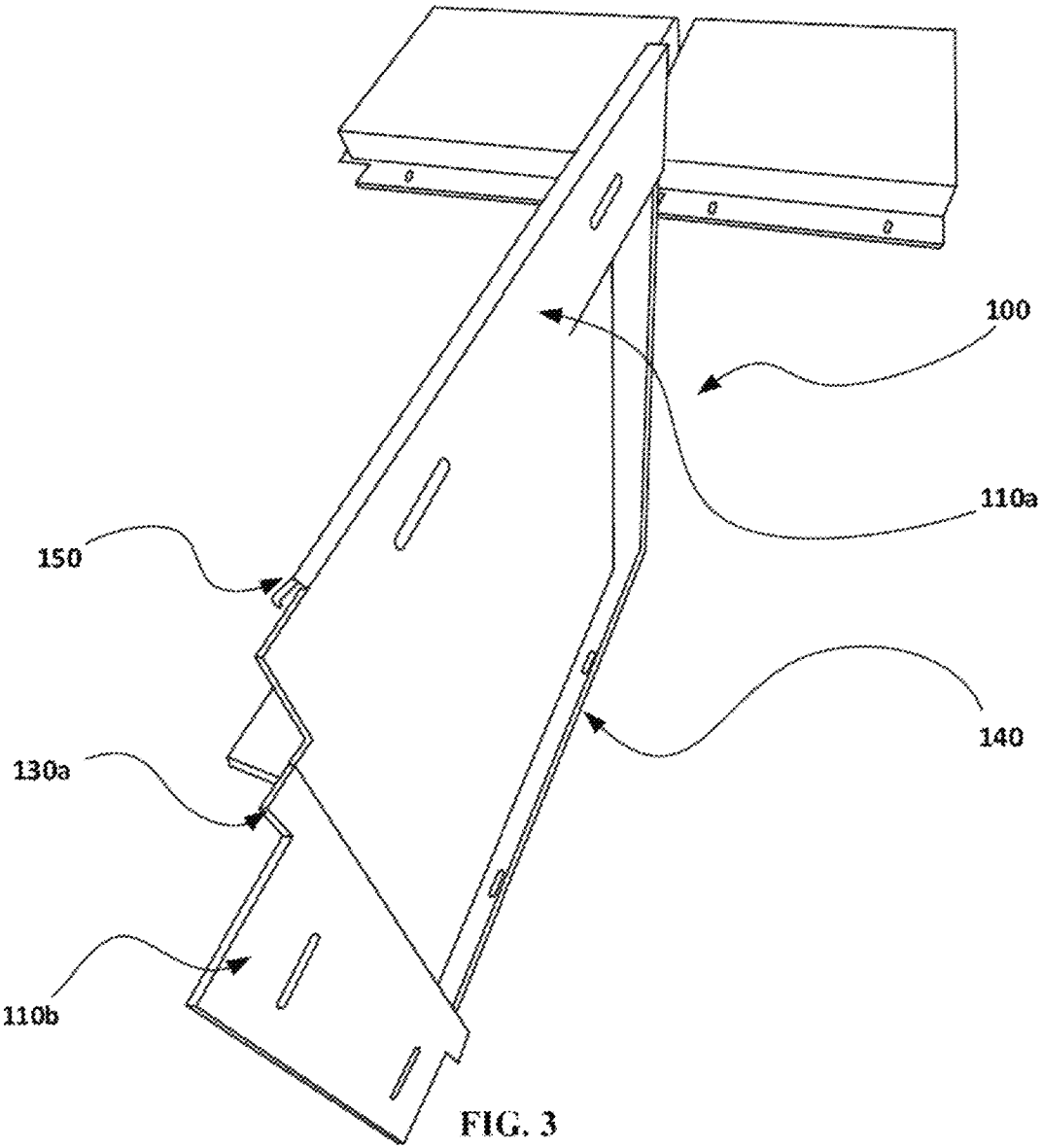
FIG. 3 is a rear perspective schematic view of a panel, according to some embodiments.

The reveal face includes two reveal planes 110*a* and 110*b* each extending from the panel 100 away from a top edge of the panel and away from a side edge (e.g., the right side edge) of the panel, respectively. The top reveal plane 110*a* includes a protrusion 150 along a portion of the length of the top reveal plane 110*a*. The protrusion 150 facilitates assembly of panel 100 with at least one adjacent panel 100. A variety of configurations of protrusion 150 is possible. For example, in embodiments depicted, the protrusion 150 is angled towards the exterior face 120. The protrusion 150 allows an interlocking connection with an interior lip 140 (as shown in FIG. 3) at a bottom edge of a separate panel. Different interlocking connections or attachment arrangements are possible with different complementary configurations of adjacent portions of adjacent panels. The dimensions of a face of panel 100 can be adjusted to a variety of sizes, such as only subject to local building department design pressures and engineering review. In some embodiments, the interlock (e.g., the interlocking connection) and reveal planes 110*a* and 110*b* remain as described.

Figure 2:
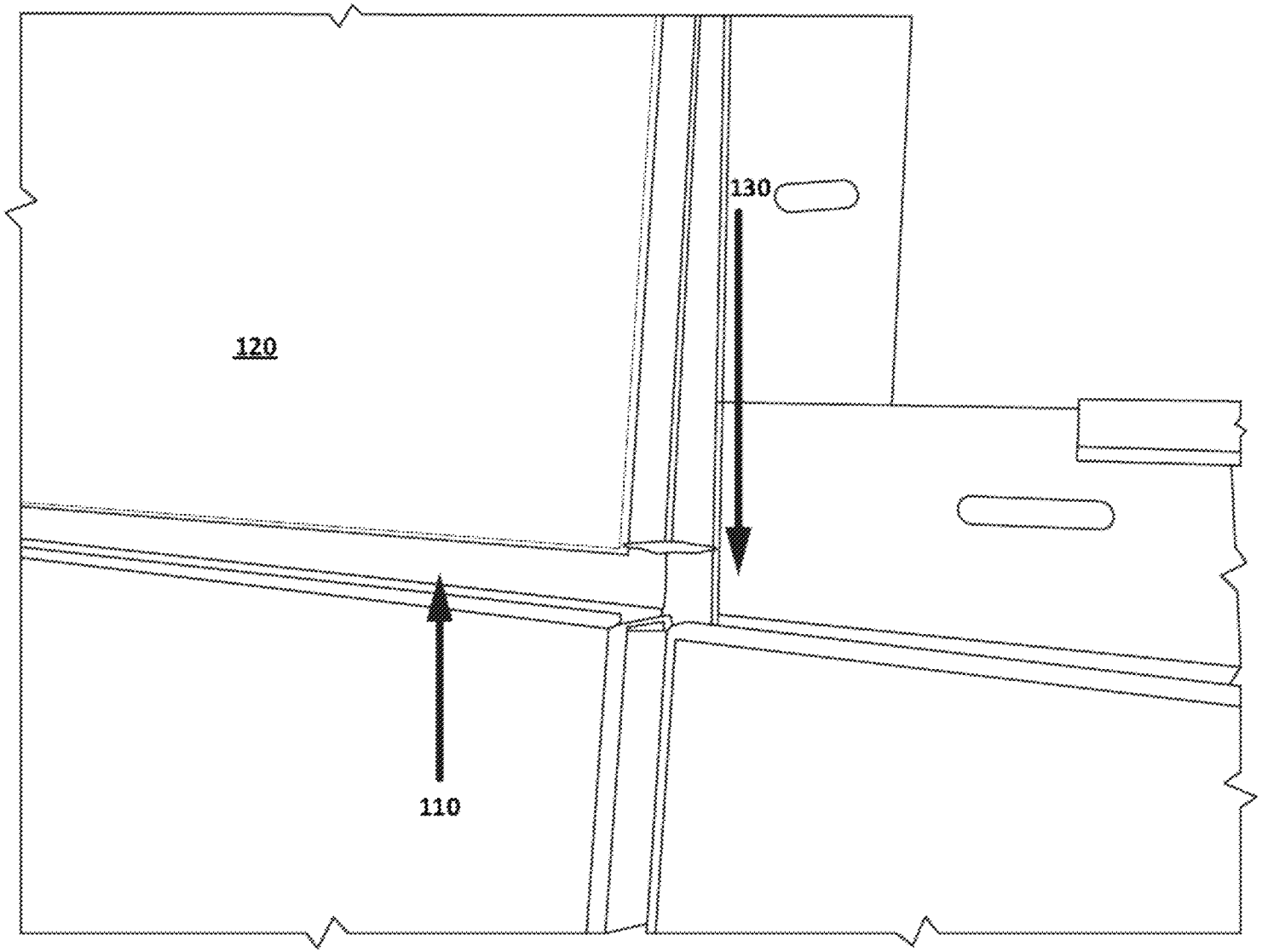
FIG. 2 is a schematic view of a panel system, according to some embodiments.

With reference to FIGS. 1 and 2, the side reveal plane 110*b* includes an alignment tab 130 at each of two ends of the side reveal plane 110*b*. The side reveal plane 110*b* extends from a location near the bottom edge of the exterior face 120 to a distance above the top edge of the exterior face 120 on a plane parallel to the plane defined by the exterior face 120. The portion of the side reveal plane 110*b* that extends the distance above the top edge of the exterior face 120 defines an alignment tab 130*a*. As side reveal plane 110*b* extends away from the side edge of exterior face 120 along a first axis, alignment tab 130*a* also extends in a direction along that same first axis, but extends along that first axis by a shorter distance. The difference in distance between the distance that the alignment tab 130*a* extends along that first axis and the distance that the adjacent portions of the side reveal plane 110*b* extends along that first axis defines an indent in side reveal plane 110*b*.

On assembly with an adjacent panel 100 positioned near the right edge of exterior face 120 of the panel 100, the edges of side reveal plane 110*b* at the indent abut portions of a top reveal plane 110*a* of the adjacent panel 100. In particular, the indent defined along a right edge of the alignment tab 130*a* portion of side reveal plane 110*b* abuts a left edge of the top reveal plane 110*a* of the adjacent panel, and the indent defined along the portion of the side reveal plane 110*b* adjoining the alignment tab 130*a* abuts a bottom edge of the top reveal plane 110*a* of the adjacent panel 100. This bottom edge can be positioned on an interior side of the adjacent panel 100 and hidden from view in a front view of the adjacent panel 100, the front view defined by the exterior face 120 of the adjacent panel 100. Alignment tab 130*a* can facilitate alignment and correct positioning of the panel 100 with the adjacent panel 100. For example, panels 100 can be installed having a square, plumb, and level positioning relative to each other. The distance that alignment tab 130*a* extends along the first axis defines the length of a spacing (measured along the first axis) between opposing edges (e.g., right side edge and left side edge) of the exterior face 120 of the panel 100 and the exterior face 120 of the adjacent panel 100. In some embodiments, this spacing can facilitate water drainage such as from precipitation and improve longevity and management of an assembled panel system, for example, installed as part of a P.E.R. building envelope.

On assembly with another adjacent panel 100 positioned above the top edge of exterior face 120 of the panel 100, a top edge of alignment tab 130*a* of the panel 100 abuts a bottom edge of alignment tab 130*b* of the other adjacent panel 100. These alignment tabs 130*a*, 130*b* can facilitate alignment and correct positioning of the panel 100 with the other adjacent panel 100. For example, panels 100 can be installed having a square, plumb, and level positioning relative to each other. The distance that alignment tab 130*a* extends above the top edge of exterior face 120 of panel 100 defines the length of a spacing (measured along the axis that the distance is measured along) between opposing edges of the exterior face 120 of the panel 100 and the exterior face 120 of the other adjacent panel 100 (e.g., between a top edge of the exterior face 120 of the panel 100 and a bottom edge of the exterior face 120 of the other adjacent panel 100). In some embodiments, this spacing can facilitate water drainage such as from precipitation and improve longevity and management of an assembled panel system, for example, installed as part of a P.E.R. building envelope. A left edge of alignment tab 130*a* of the panel 100 abuts a portion of the right edge of top reveal plane 110*a* of the panel 100.

The alignment tabs 130*a*, 130*b* and the portions of the top reveal plane 110*a* and side reveal plane 110*b* that define the respective spacings between adjacent panels 100 collectively form the reveal face of panel 100 and are flush with each other (e.g., abut adjacent components of the reveal face). For example, once assembled, the exposed portions of reveal planes 110*a*, 110*b* are flush with the exposed portions of reveal planes 110*a*, 110*b* of adjacent panels 100 on all abutting sides. As a further example, the reveal plane uniquely remains consistent around the entire panel. This can facilitate water management of the assembled panel system and reduction of leaking or gaps in the assembled panel system, as well as provide improved aesthetics. For example, water can travel more easily along a flush reveal face and the reveal face can direct drainage of the water to the bottom of a panel system, such as a panel system installed at an exterior surface of an exterior building wall.

The top reveal plane 110*a* of panel 100 extends a distance from a location near the left side edge of the exterior face 120 to a location near the right side edge of the exterior face 120, on a plane parallel to the plane defined by the exterior face 120. In some embodiments, the top reveal plane 110*a* only extends a distance that is just short of the right side edge of the exterior face 120, but, on assembly with an adjacent panel, is hidden under the exterior face of the adjacent panel. This arrangement can help conceal the butt joint of materials to the adjacent panel and can help keep the joint hidden aesthetically.

The side reveal plane 110*b* defines an alignment tab 130*b* at a bottom end of the side reveal plane 110*b*, the bottom end near the bottom edge of the exterior face 120 on a plane parallel to the plane defined by the exterior face 120. As side reveal plane 110*b* extends away from the side edge of exterior face 120 along a first axis, alignment tab 130*b* also extends in a direction along that same first axis, but extends along that first axis by a shorter distance. The difference in distance between the distance that the alignment tab 130*b* extends along that first axis and the distance that the adjacent portions of the side reveal plane 110*b* extends along that first axis defines an indent in side reveal plane 110*b*.

In some embodiments, on assembly with an adjacent panel 100 positioned near the bottom right edge of reveal plane 110*b*, the edges of side reveal plane 110*b* at the indent abut portions of a top reveal plane 110*a* of the adjacent panel 100. For example, this adjacent panel 100 can be assembled to be positioned below (e.g., interlocking with a bottom edge of) a separate panel 100 that is positioned to the right (e.g., near and along the right edge of the exterior face 120) of the panel 100. In particular, the indent defined along a right edge of the alignment tab 130*b* portion of side reveal plane 110*b* abuts a left edge of the top reveal plane 110*a* of the adjacent panel 100, and the indent defined along the portion of the side reveal plane 110*b* adjoining the alignment tab 130*b* abuts a top edge of the top reveal plane 110*a* of the adjacent panel 100. Alignment tab 130*b* can facilitate alignment and correct positioning of the panel 100 with the adjacent panel 100. For example, panels 100 can be installed having a square, plumb, and level positioning relative to each other.

The distance that alignment tab 130*b* extends along the first axis defines the length of a spacing (measured along the first axis) between opposing edges (e.g., right side edge and left side edge) of the exterior face 120 of the panel 100 and the exterior face 120 of another adjacent panel 100 positioned near and along the right edge of reveal plane 110*b*. The distance also defines the length of a corresponding spacing between the panel 100 and the adjacent panel 100 (positioned near the bottom right edge of reveal plane 110*b* of panel 100) measured as the distance apart along the same axis.

In some embodiments, this spacing can facilitate water drainage such as from precipitation and improve longevity and management of an assembled panel system, for example, installed as part of a P.E.R. building envelope. For example, in some embodiments, this spacing can allow water to drain along an aligned channel (defined by the spacing) through an assembled panel system of panels 100 from the top most panel 100 to the bottom most panel 100.

In some embodiments, the dimension of the indent measured along the right edge of alignment tab 130*b* defines the length that a reveal plane 110*a* of the bottom right adjacent panel 100 extends under a bottom edge of the exterior face 120 of the adjacent panel 100, the adjacent panel 100 being a panel 100 that is positioned above the top edge of the exterior face 120 of the bottom right adjacent panel 100.

The alignment tabs 130 can help maintain a square and level alignment between adjacent panels 100. In some embodiments, each alignment tab 130 is defined in the reveal plane 110 as an indent at the edge of the reveal plane 110. For example, on assembly, an adjacent panel's 100 reveal plane 110 is positioned flush with the reveal plane 110 of the panel 100 and, in particular, flush with an edge of an alignment tab 130 defined at that portion of the reveal plane 110.

FIG. 3 is a diagram showing an example panel 100 and interlocking components for an interlocking assembly design according to some embodiments. In some embodiments, the interlock design allows single component installation and a consistent reveal plane.

With reference to FIGS. 1 and 3, on assembly, a top reveal plane 110*a* of a first panel 100 is positioned or inserted under the bottom edge of a second panel 100 and the protrusion 150 of the first panel 100 interlocks with the interior lip 140 at the bottom edge of the second panel 100. The interlocking can be facilitated by gravity, for example. A top alignment tab 130*a* of a side reveal plane 110*b* of the first panel 100 abuts a bottom alignment tab 130*b* of the second panel 100 and is flush with same. The side reveal plane 110*b* of the first panel 100 is positioned or inserted under the left side edge of a third panel 100. In some embodiments, the panel system provides a modular panel system with an interlocking feature, such that the panel system does not require additional components to install a panel 100 to another panel 100. For example, no other component may be required other than the panels 100 in an assembled panel system. No other component may be required in an assembly securing a panel 100 to one or more other panels 100. In some embodiments, this can improve safety and longevity as any requirement for combustible components to be included in an assembled panel system is removed according to some embodiments. Panels 100 can be made out of non-combustible material. Aluminum, steel sheet, copper, zinc, bronze, ACM material, brass, stainless steel, and/or titanium can be used to make panels 100, for example.

In some embodiments, the components of panel 100 are configured in other orientations and/or positions relative to each other and words of orientation used herein are exemplary and not intended to be limiting. For example, panel 100 can have one or more reveal planes 110 extending from any one or more of a top, right, bottom, or left side edge of the panel 100 with complementary positioning of corresponding components at adjacent panels to facilitate attachment similar to that described in the foregoing. For example, panel 100 can have a reveal plane 110 extending from each of a left side edge and top edge of the panel 100, and, on assembly, the left side edge reveal plane can be positioned under the right side edge of an adjacent panel 100 and the top edge reveal plane can be positioned under the bottom edge of another adjacent panel 100. As another example, protrusion 150 can extend from a right side edge reveal plane 110*b* instead of or in addition to a protrusion 150 extending from a top edge reveal plane 110*a*. As another example, alignment tabs 130 can extend from a top edge reveal plane 110*a* or left side edge reveal plane instead of a right side edge reveal plane 110*b*. A panel 100 can have only two reveal planes shared with adjoining panels, for example. In some embodiments, reveals can be widened or narrowed according to certain engineering and/or installation parameters. Returns (e.g., connection between an exterior face and a reveal) from a panel face (e.g., exterior face) can be staggered or angular, for example. This can help achieve variable planes or staggered planes on the face of the panel (e.g., exterior face 120 can be staggered or angular). In some embodiments, the exterior face 120 and/or returns are staggered or angular, while the interlocking connection and reveal planes (e.g., 110*a* and 110*b*) are configured as described herein.

In some embodiments, assembly of one or more panels 100 can be arranged in other orientations and/or positions and words of orientation used herein are exemplary and not intended to be limiting. For example, relative words such as "top", "bottom", "right", and "left" can each refer to a different orientation than described (e.g., "top" can refer to "bottom" and "bottom" can refer to "top"), such as if the panel system is assembled along a vertical, horizontal, or angled axis, or along another other orientation or if the panel system is assembled in a different orientation about an axis extending orthogonally through the panel, where the orthogonal axis is relative to an axis defined by the exterior face 120. Embodiments described refer to orientations indicated relative to the example panel 100 shown in FIG. 1. Other orientations are possible, with any corresponding modifications to corresponding or complementary components of the panel 100 or adjacent panels 100.

As used herein, "abutting" can refer to substantially abutting, such as including any acceptable spacing between the components described as abutting. Features described in relation to different embodiments are also contemplated to be incorporated in a single embodiment.

One or more panels 100 can be assembled into a panel system as described in the foregoing before or after or in conjunction with installation of the panel system at a wall. A separate installation device such as a J-channel and/or starter track can be used to secure the panel 100 to a wall such as using a screw. Example installation devices are shown in FIGS. 7A, 7B, 7C, and 7D, according to some embodiments. For example, example devices include a screw, J-channel, starter, corner, flashing, channel bar, channel device, and panel termination.

Figure 7A:
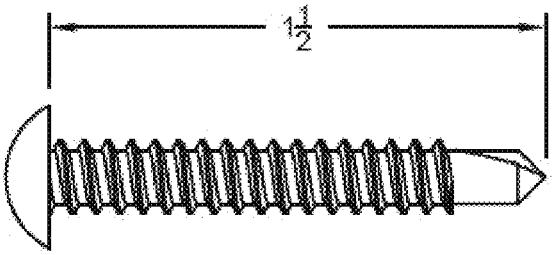
FIG. 7A is a schematic diagram showing devices for installation of one or more panels, according to some embodiments.
Figure 7B:
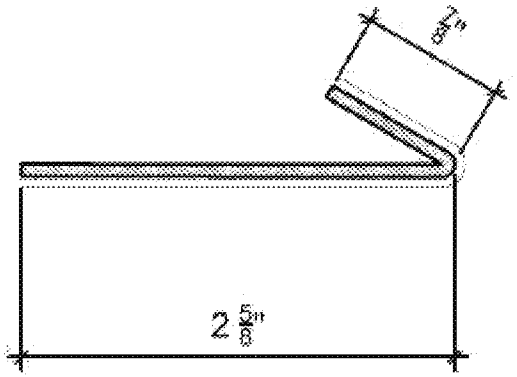
FIG. 7B is a schematic diagram showing devices for installation of one or more panels, according to some embodiments.
Figure 7C:
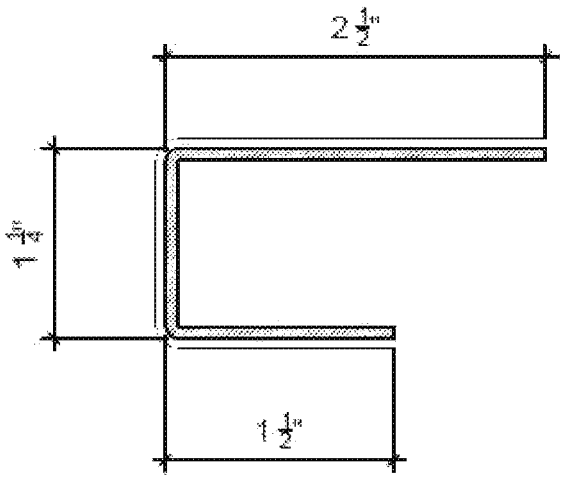
FIG. 7C is a schematic diagram showing devices for installation of one or more panels, according to some embodiments.
Figure 7D:
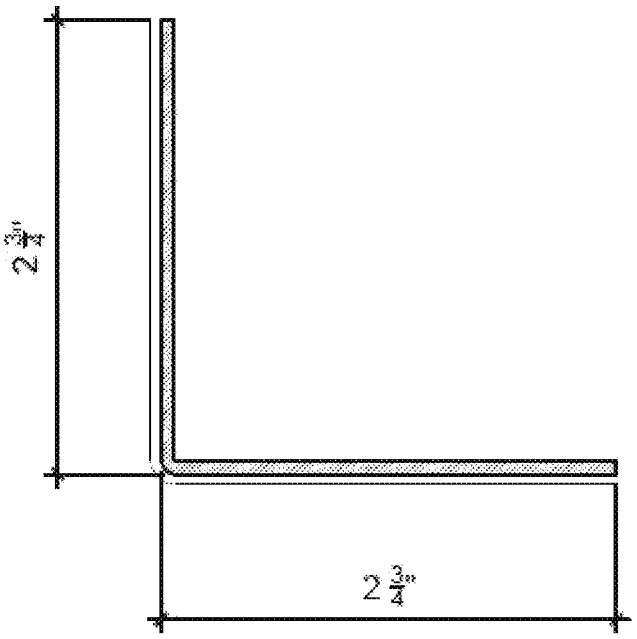
FIG. 7D is a schematic diagram showing devices for installation of one or more panels, according to some embodiments.
Figure 8A:
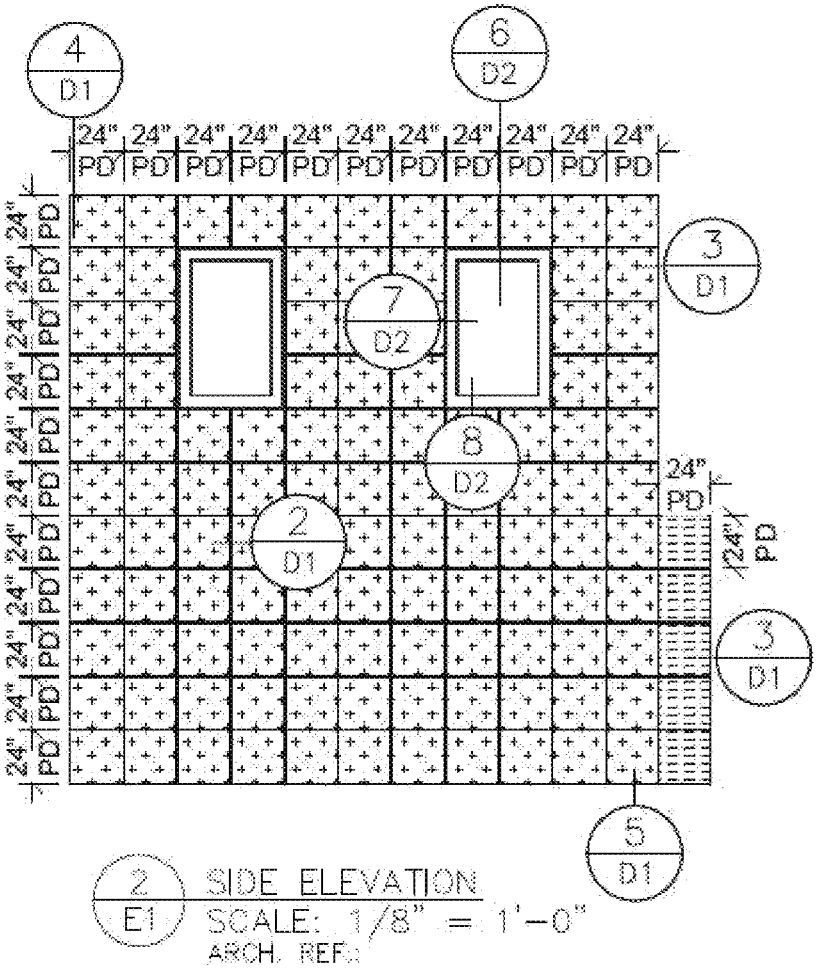
FIG. 8A is a schematic diagram showing a side elevation view of an installation of a panel system, according to some embodiments.
Figure 8B:
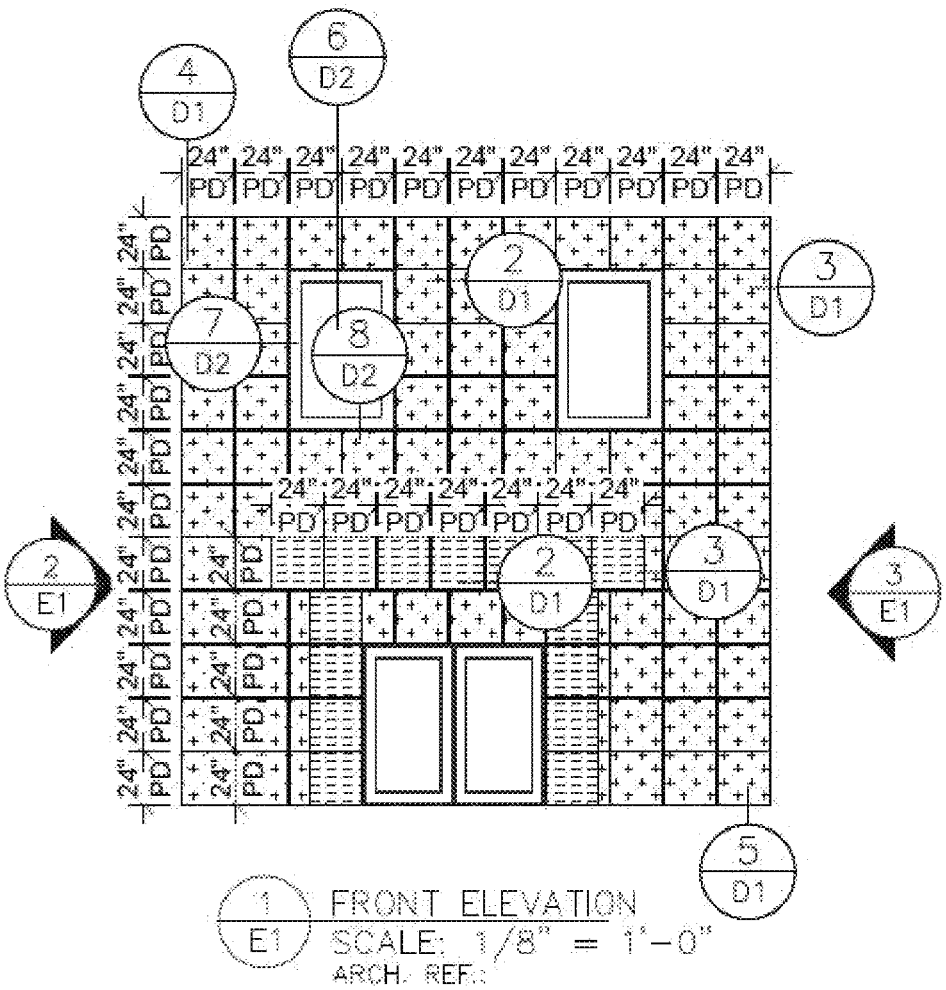
FIG. 8B is a schematic diagram showing a front elevation view of an installation of a panel system, according to some embodiments.
Figure 8C:
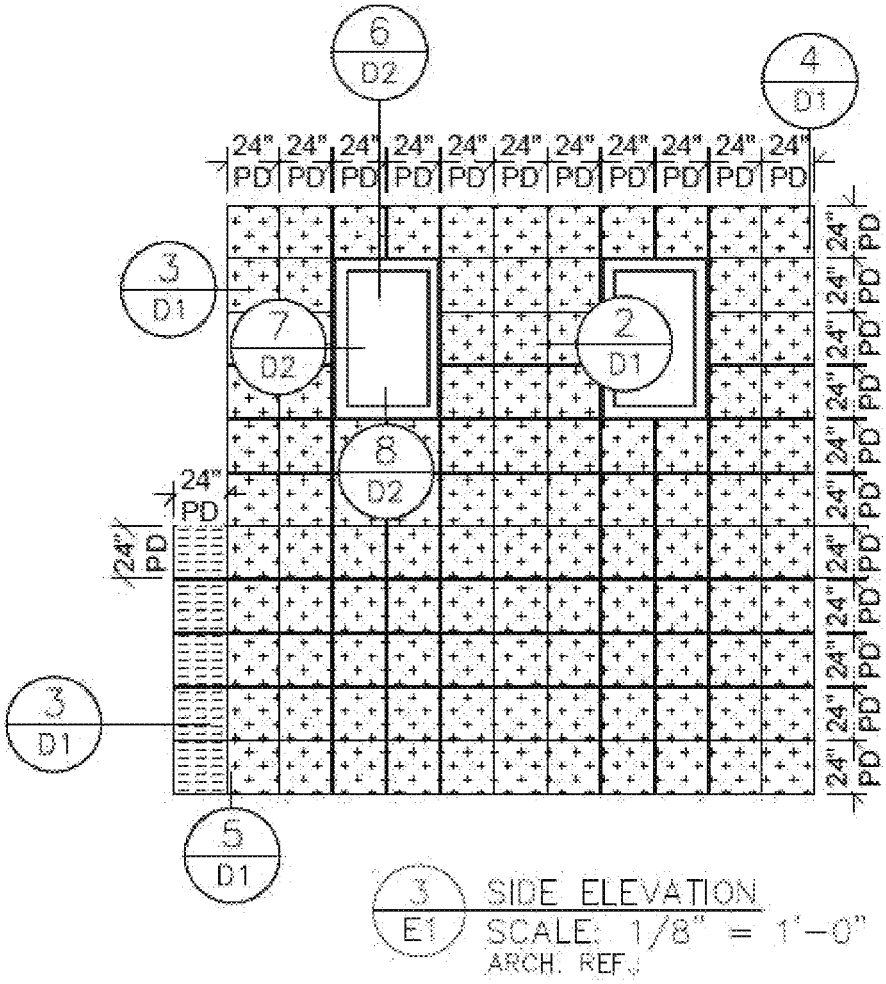
FIG. 8C is a schematic diagram showing a side elevation view of an installation of a panel system, according to some embodiments.
Figure 9A:
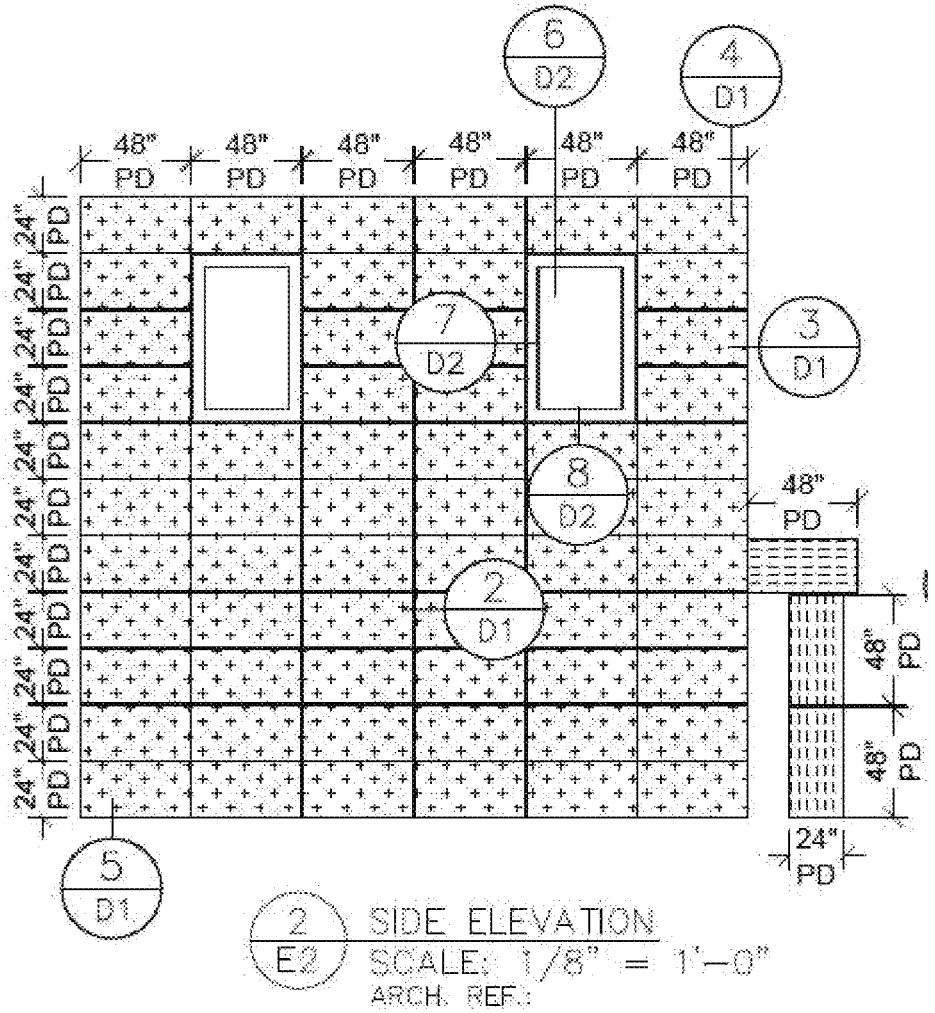
FIG. 9A is a schematic diagram showing a side elevation view of an installation of a panel system, according to some embodiments.
Figure 9B:
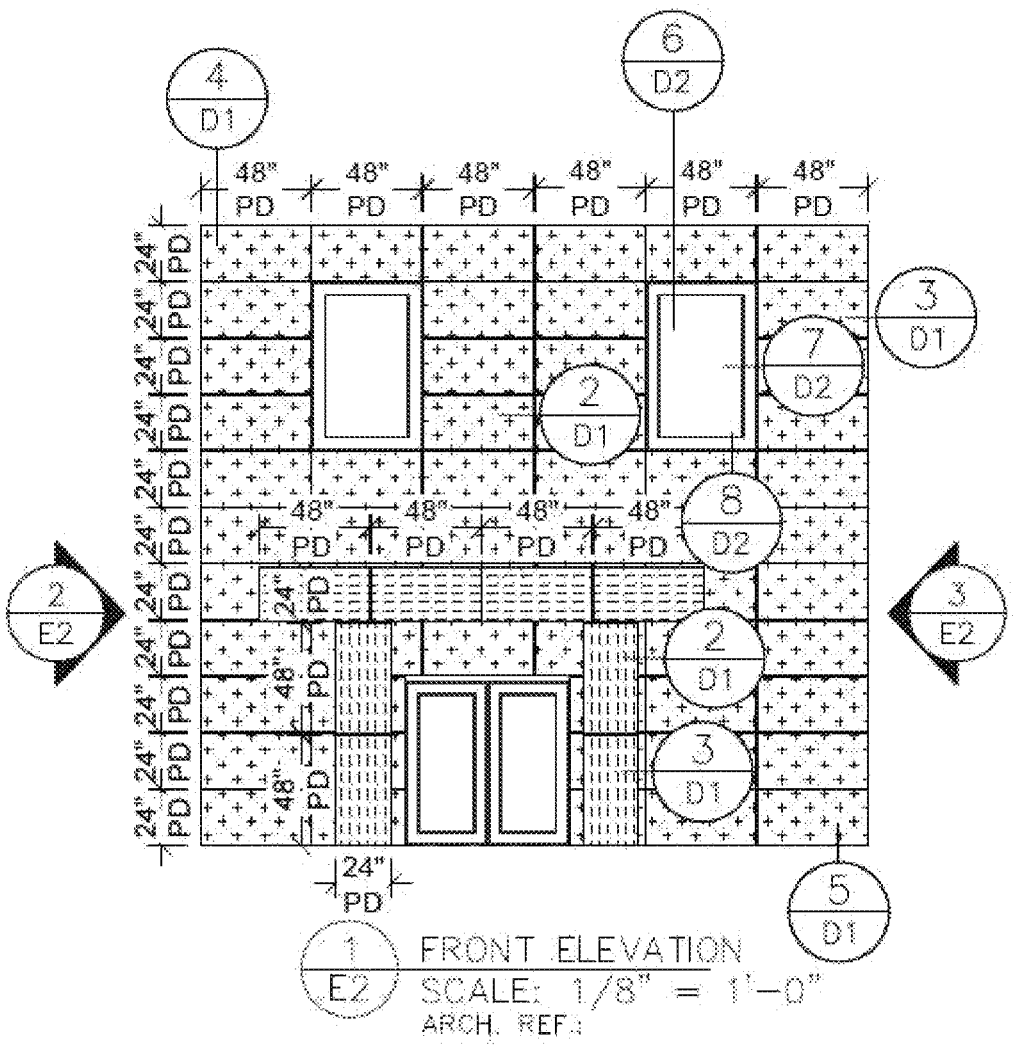
FIG. 9B is a schematic diagram showing a front elevation view of an installation of a panel system, according to some embodiments.
Figure 9C:
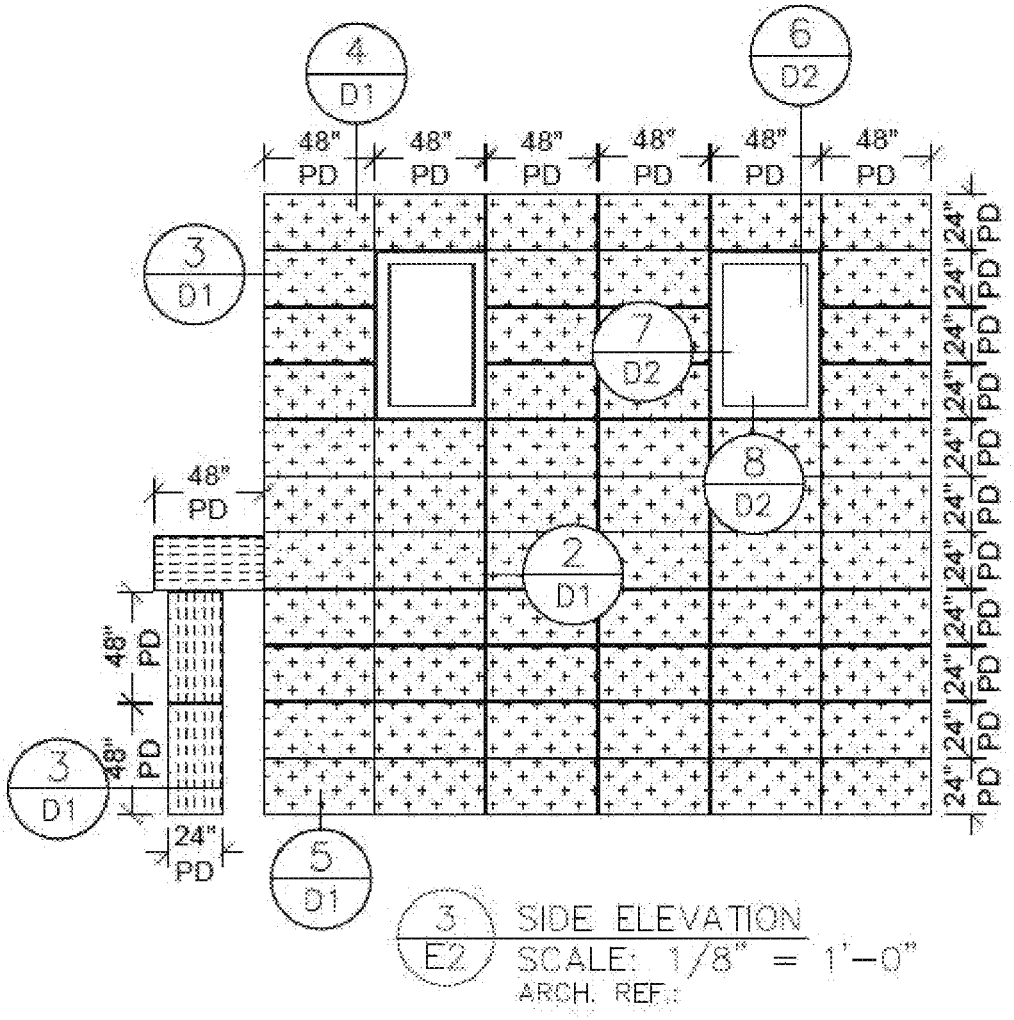
FIG. 9C is a schematic diagram showing a side elevation view of an installation of a panel system, according to some embodiments.
Figure 10A:
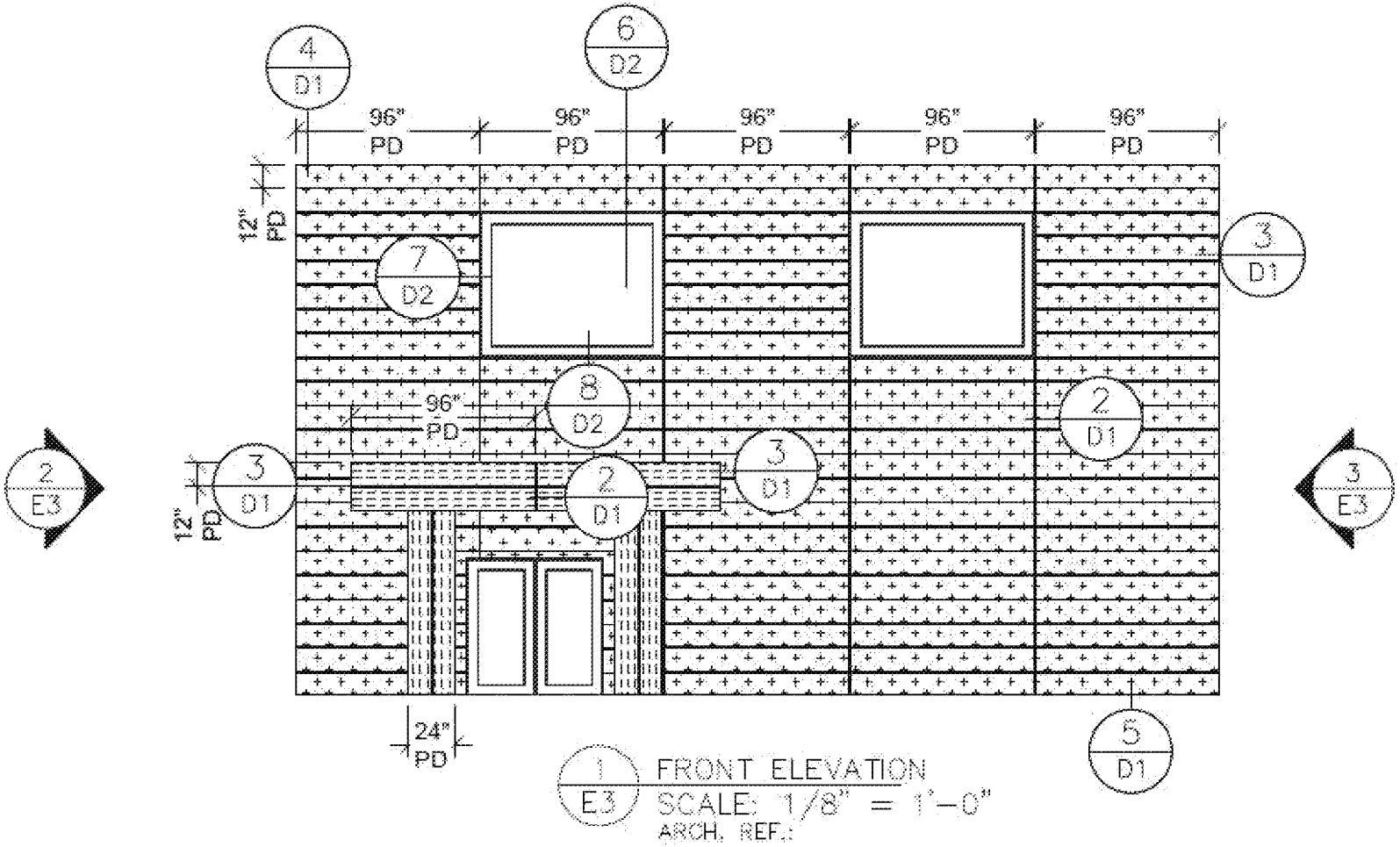
FIG. 10A is a schematic diagram showing a side elevation view of an installation of a panel system, according to some embodiments.
Figure 10B:
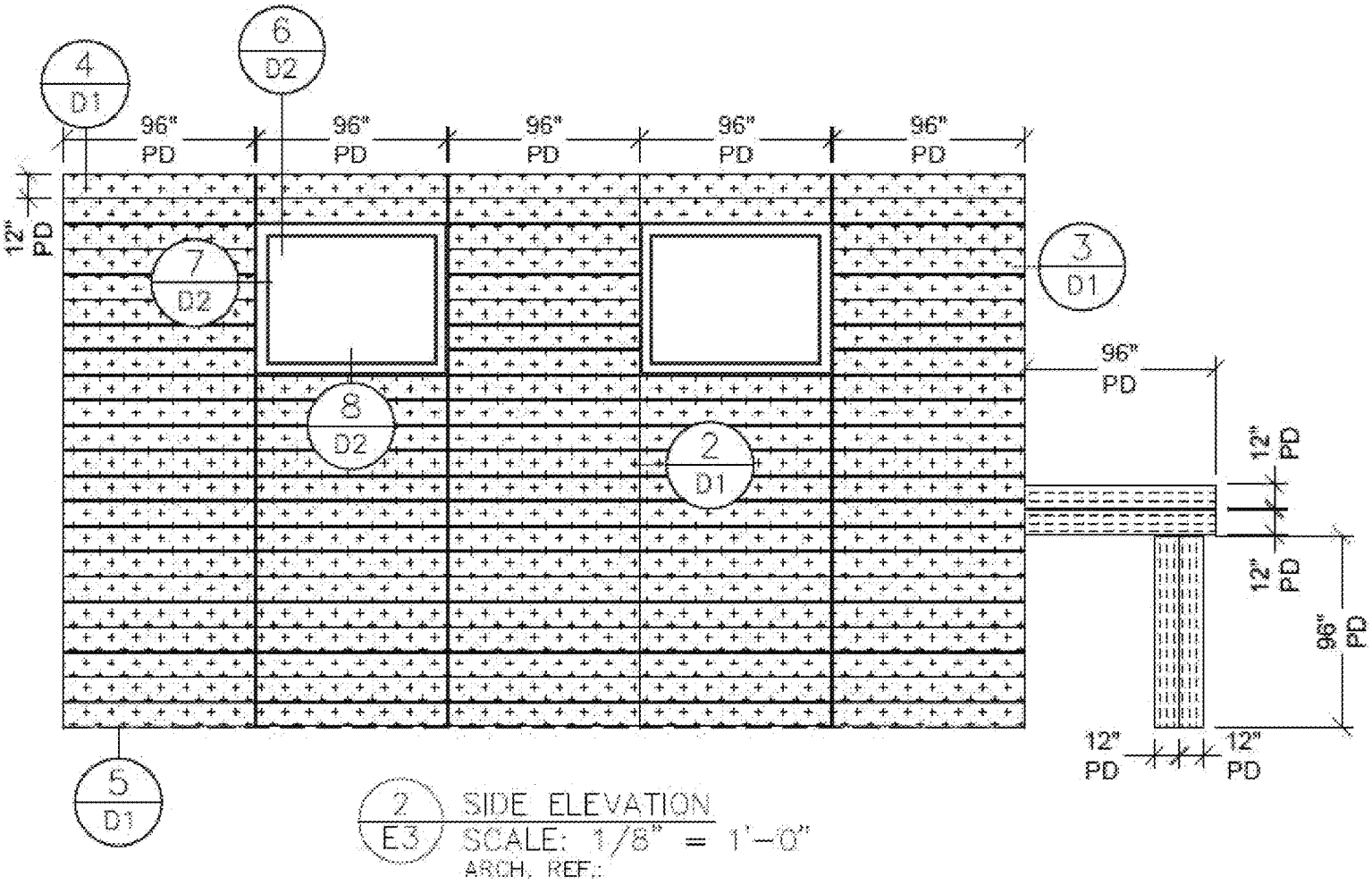
FIG. 10B is a schematic diagram showing a front elevation view of an installation of a panel system, according to some embodiments.
Figure 10C:
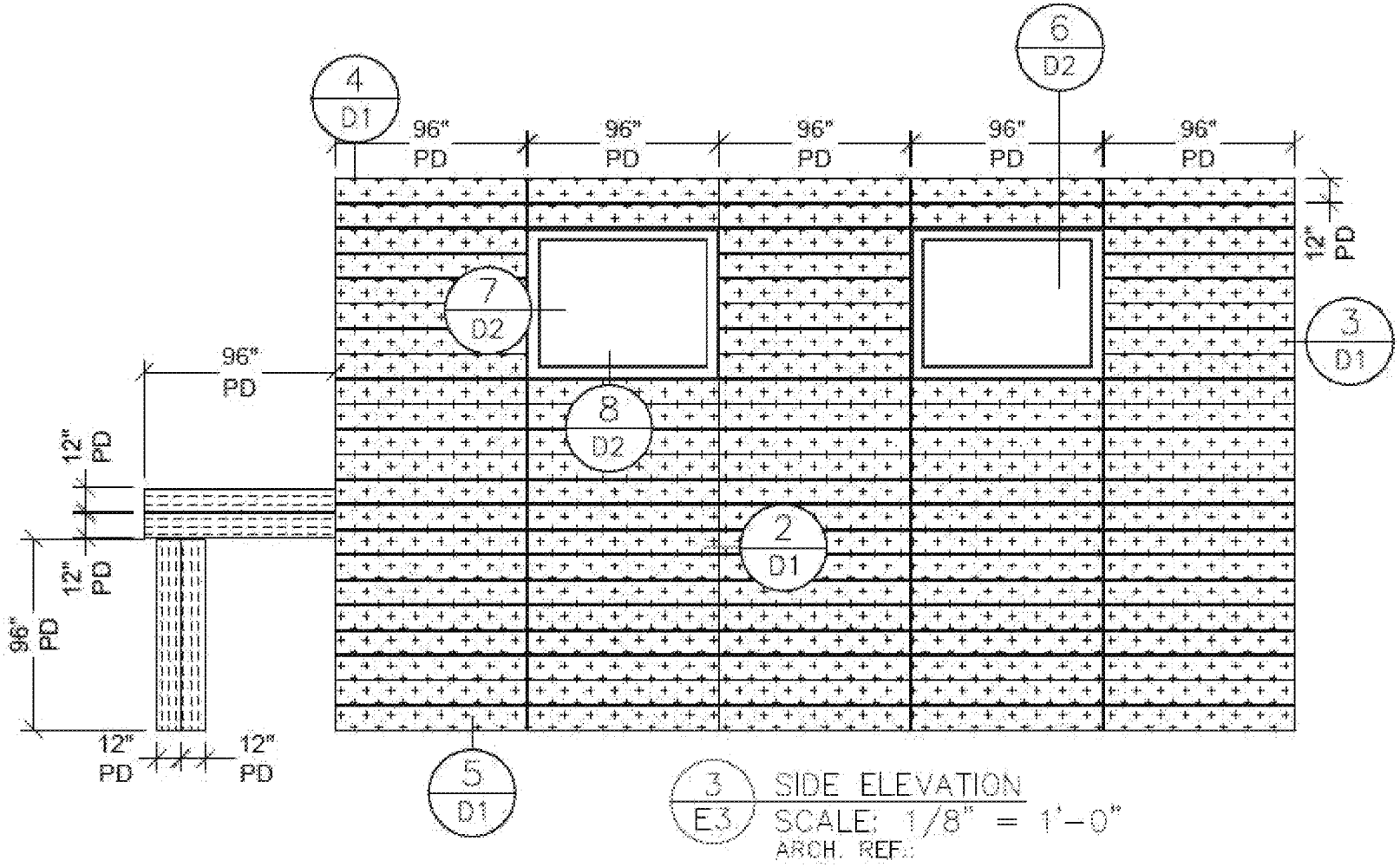
FIG. 10C is a schematic diagram showing a side elevation view of an installation of a panel system, according to some embodiments.
Figure 11A:
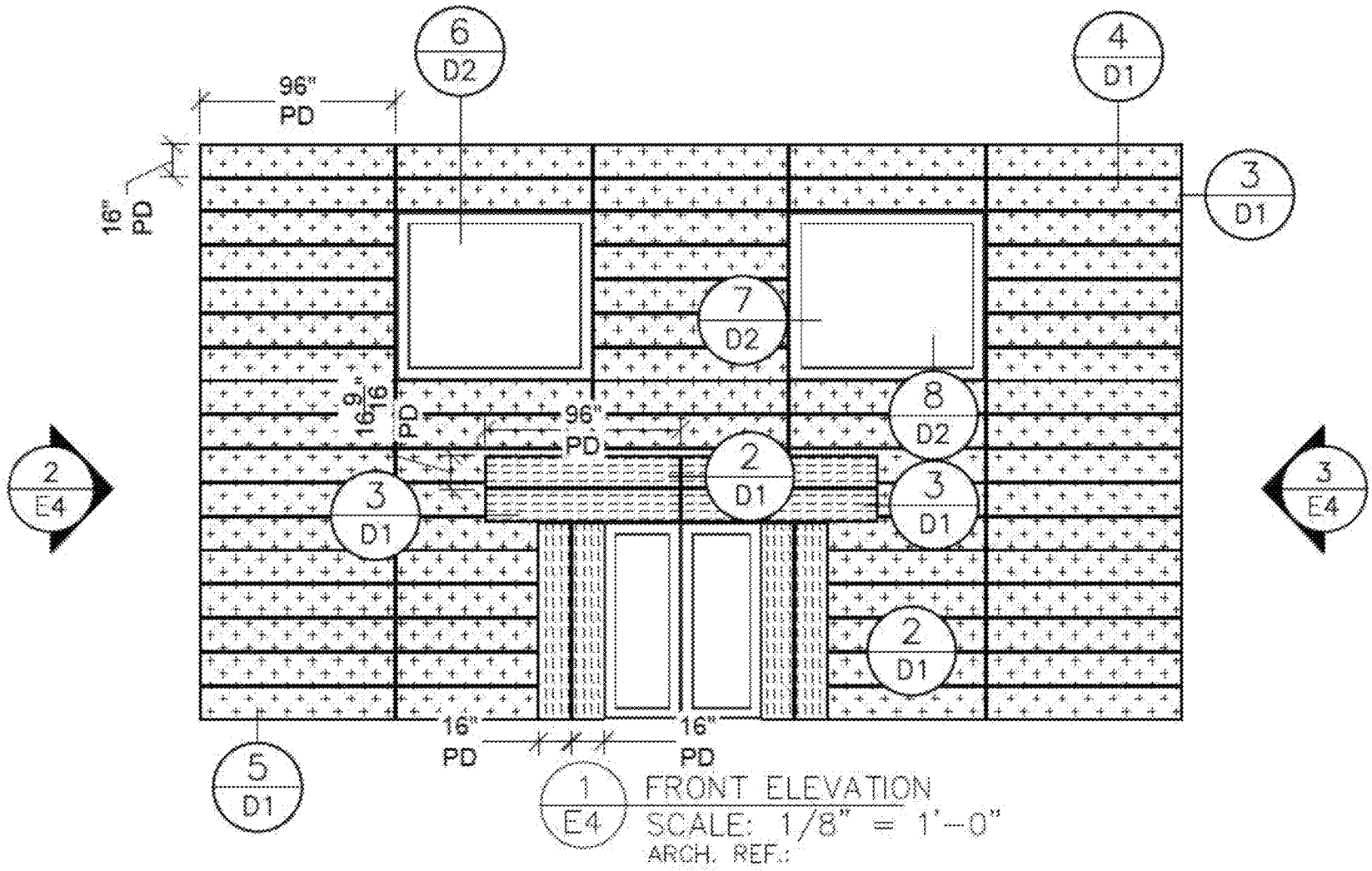
FIG. 11A is a schematic diagram showing a side elevation view of an installation of a panel system, according to some embodiments.
Figure 11B:
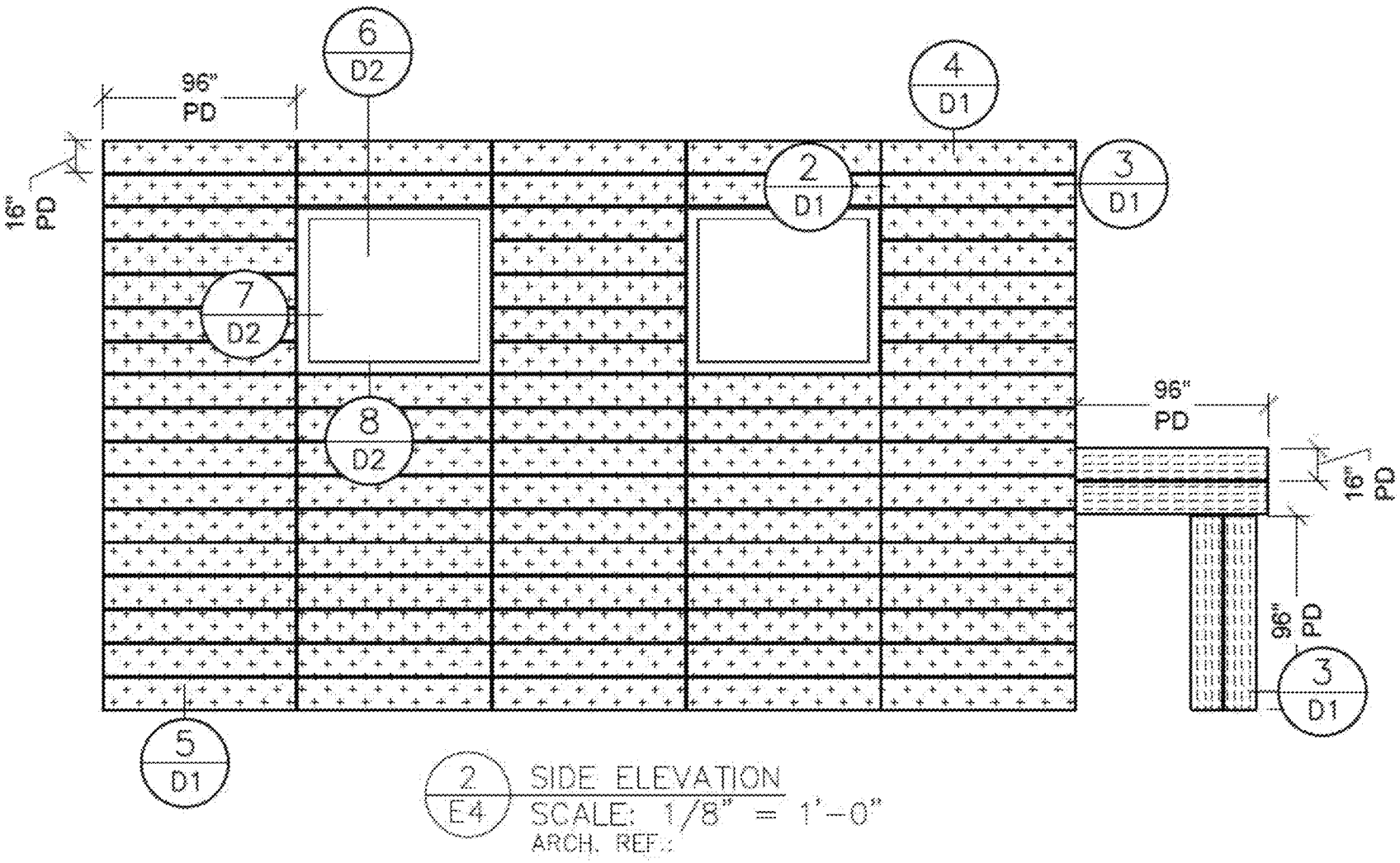
FIG. 11B is a schematic diagram showing a front elevation view of an installation of a panel system, according to some embodiments.
Figure 11C:
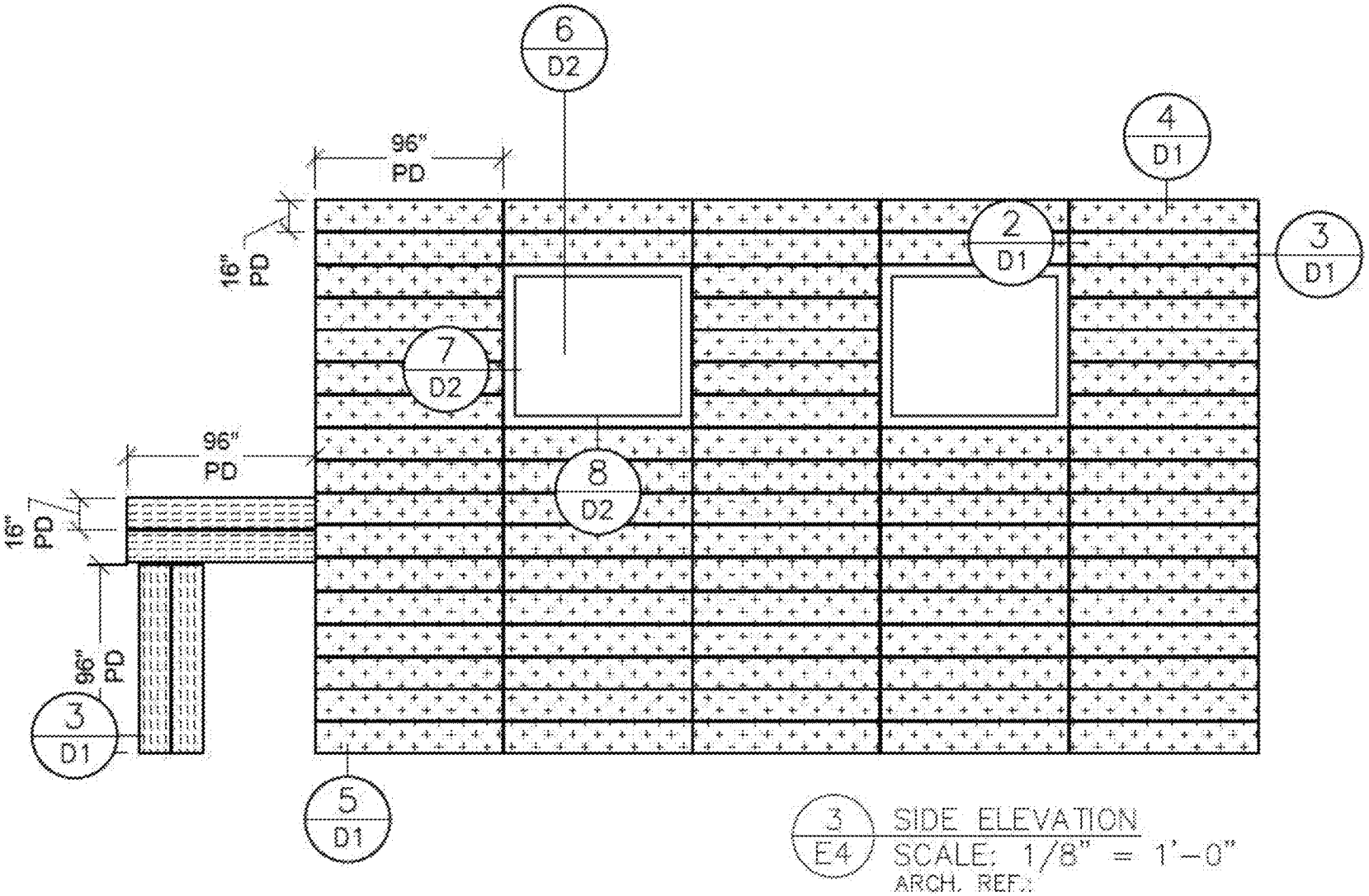
FIG. 11C is a schematic diagram showing a side elevation view of an installation of a panel system, according to some embodiments.
Figure 12A:
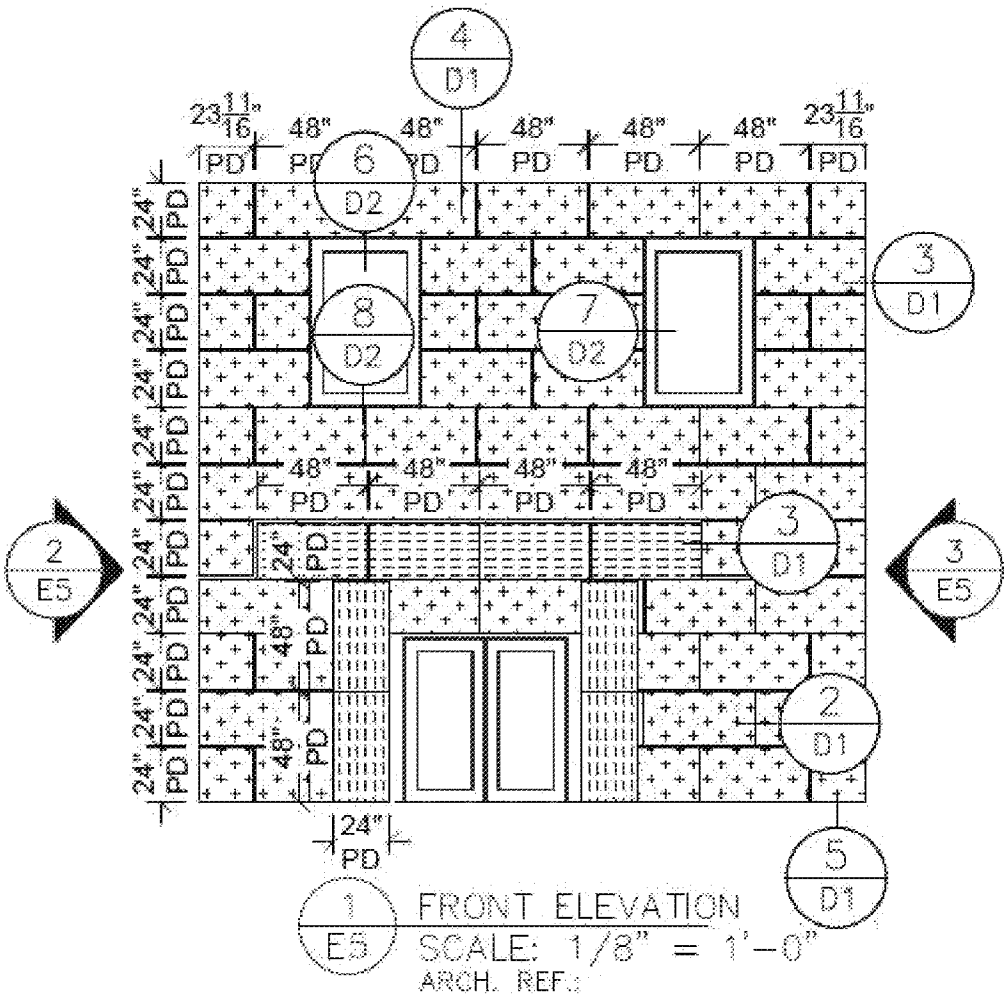
FIG. 12A is a schematic diagram showing a side elevation view of an installation of a panel system, according to some embodiments.
Figure 12C:
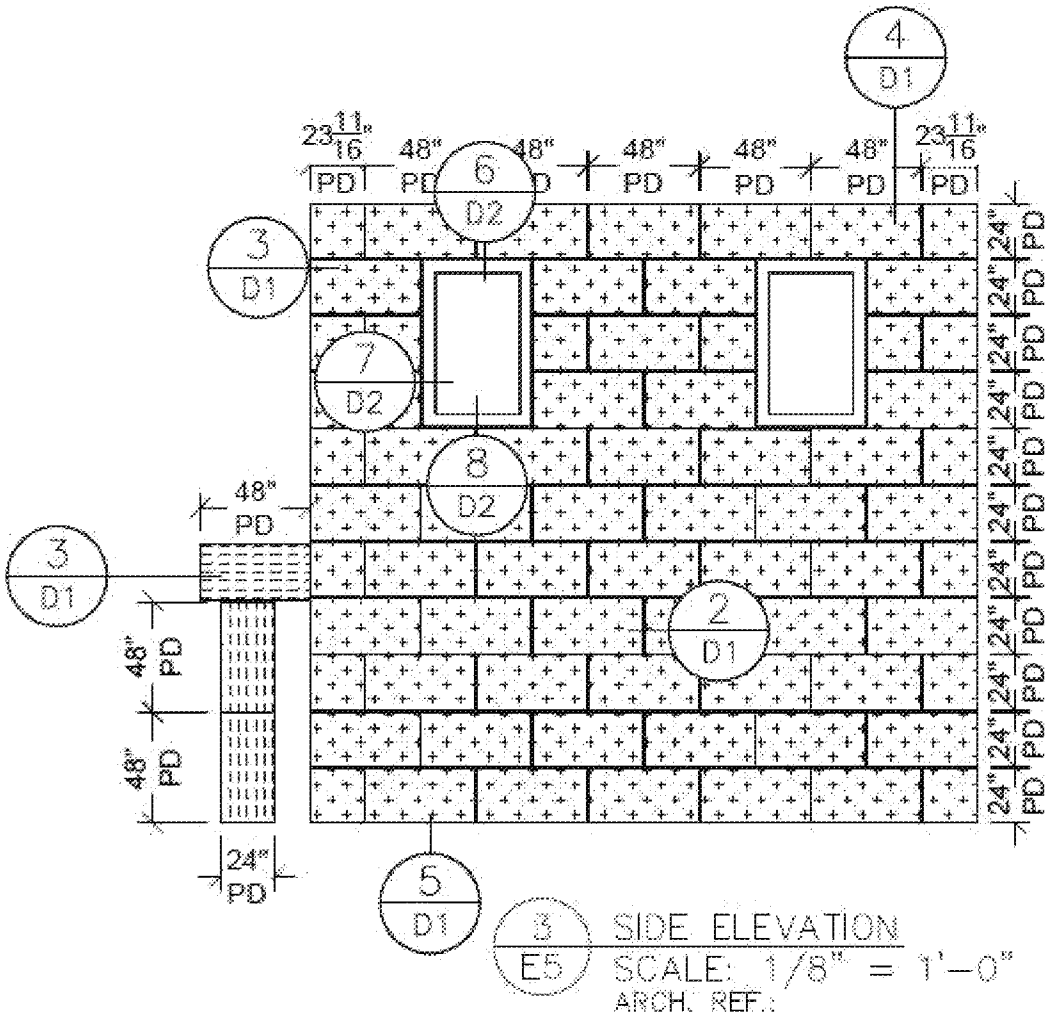
FIG. 12C is a schematic diagram showing a side elevation view of an installation of a panel system, according to some embodiments.
Figure 13A:
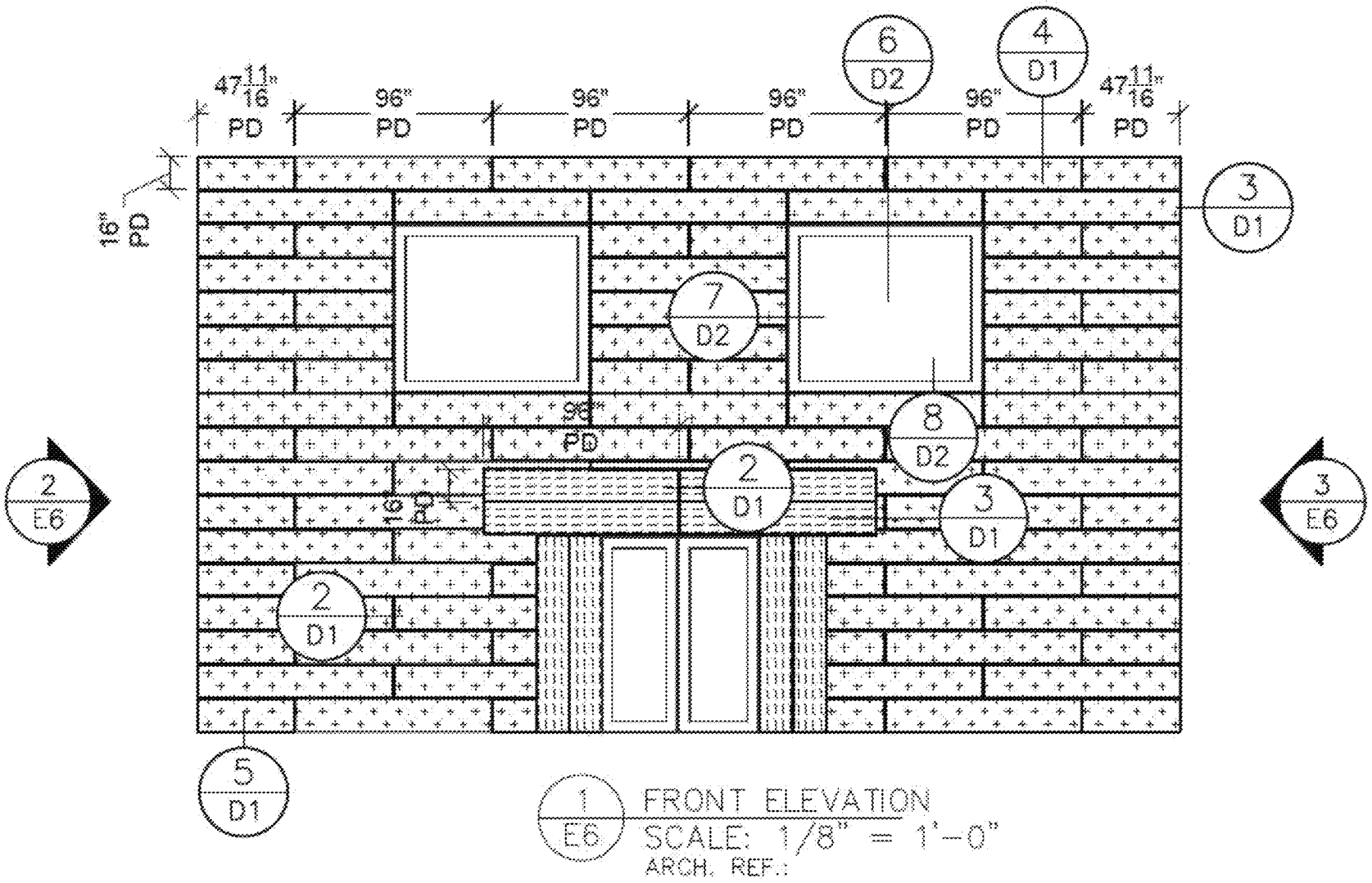
FIG. 13A is a schematic diagram showing a side elevation view of an installation of a panel system, according to some embodiments.
Figure 13B:
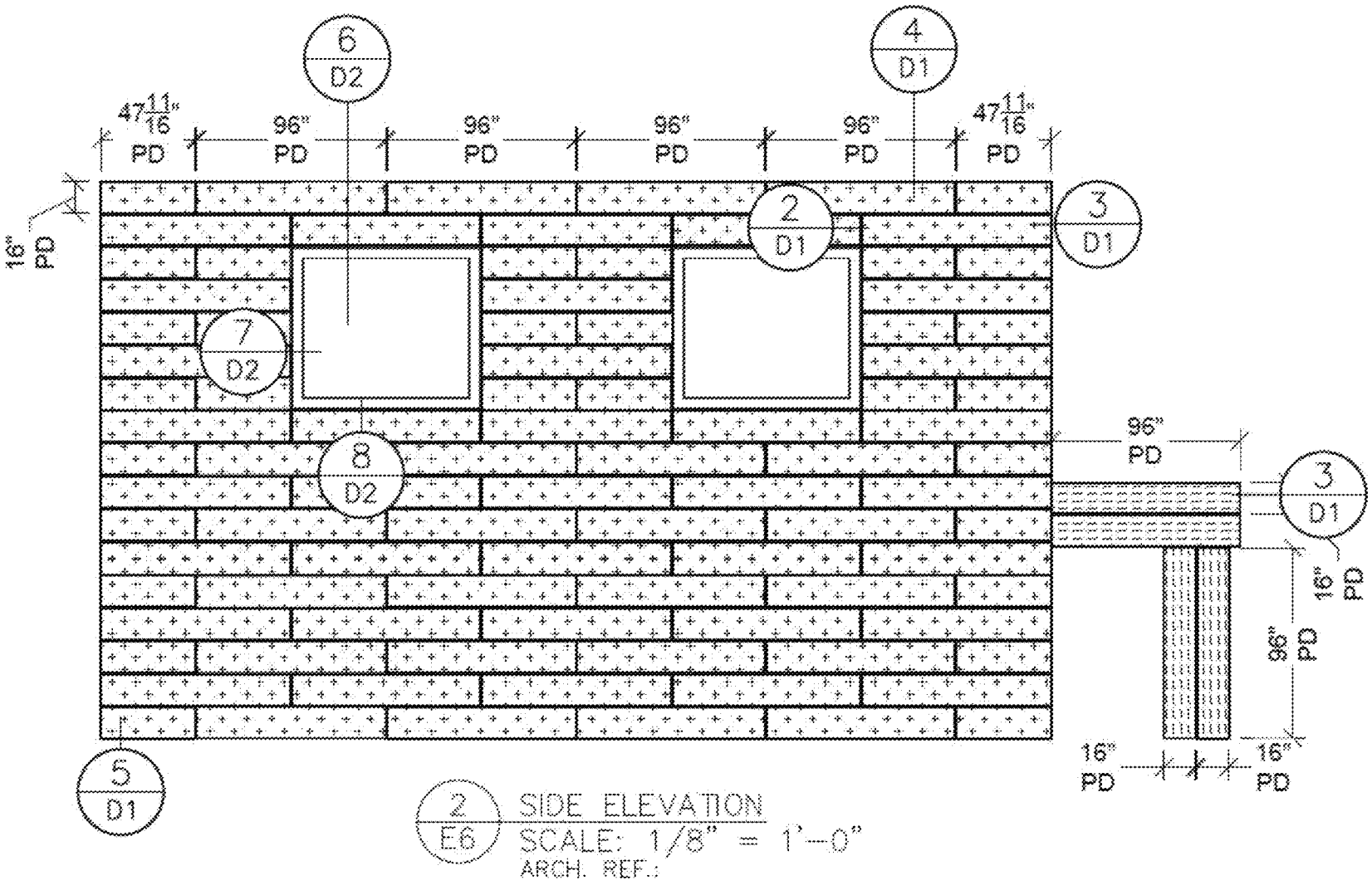
FIG. 13B is a schematic diagram showing a front elevation view of an installation of a panel system, according to some embodiments.
Figure 13C:
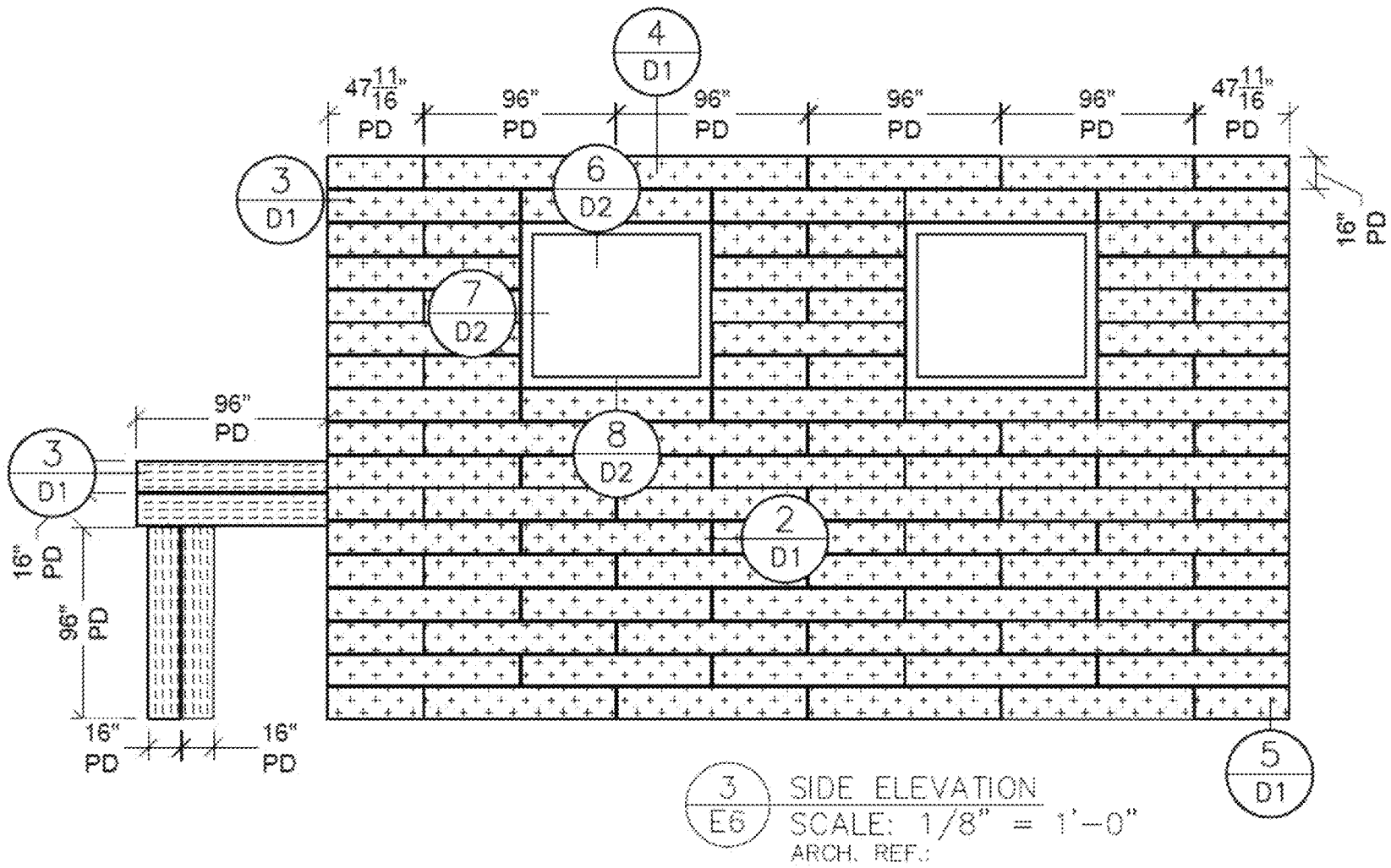
FIG. 13C is a schematic diagram showing a side elevation view of an installation of a panel system, according to some embodiments.
Figure 14:
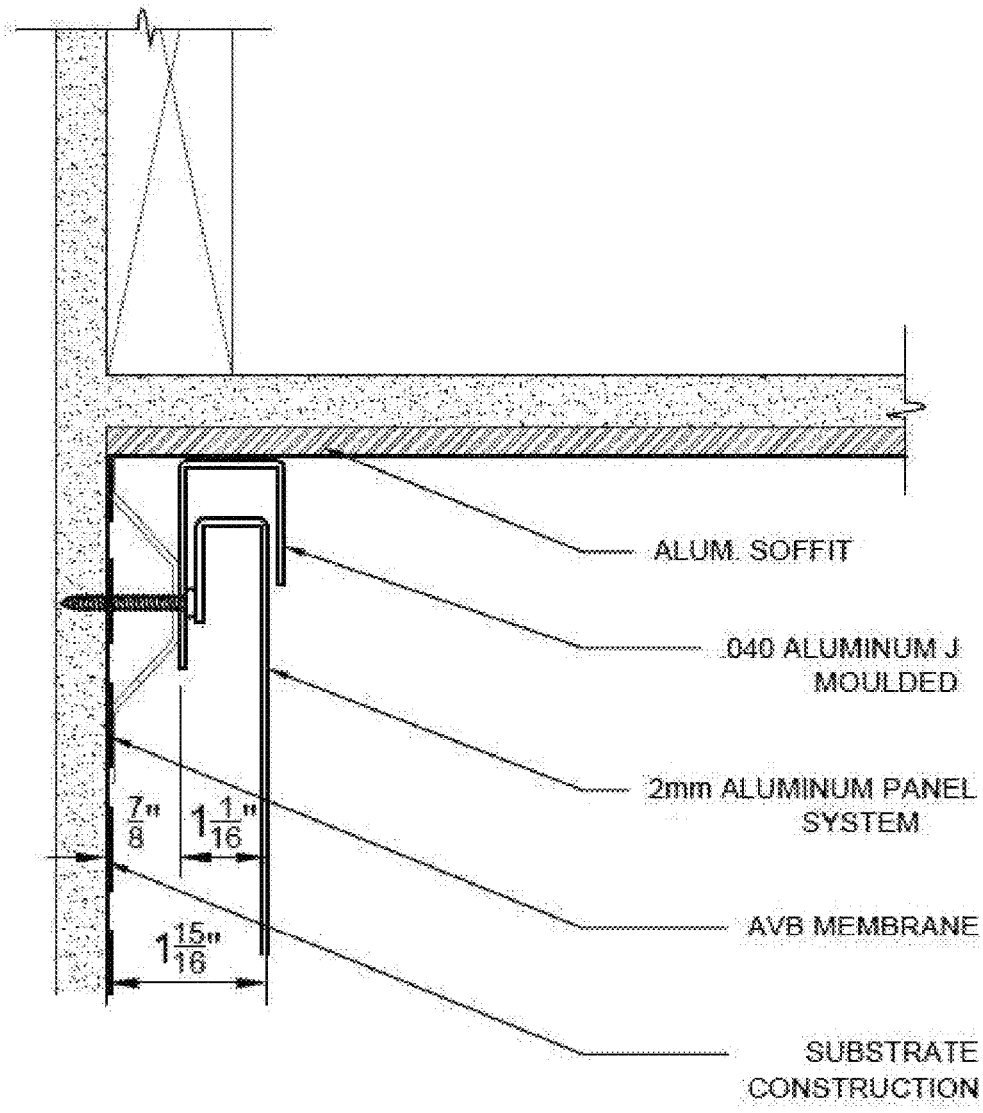
FIG. 14 is a schematic diagram showing an installation of one or more panels, according to some embodiments.
Figure 15:
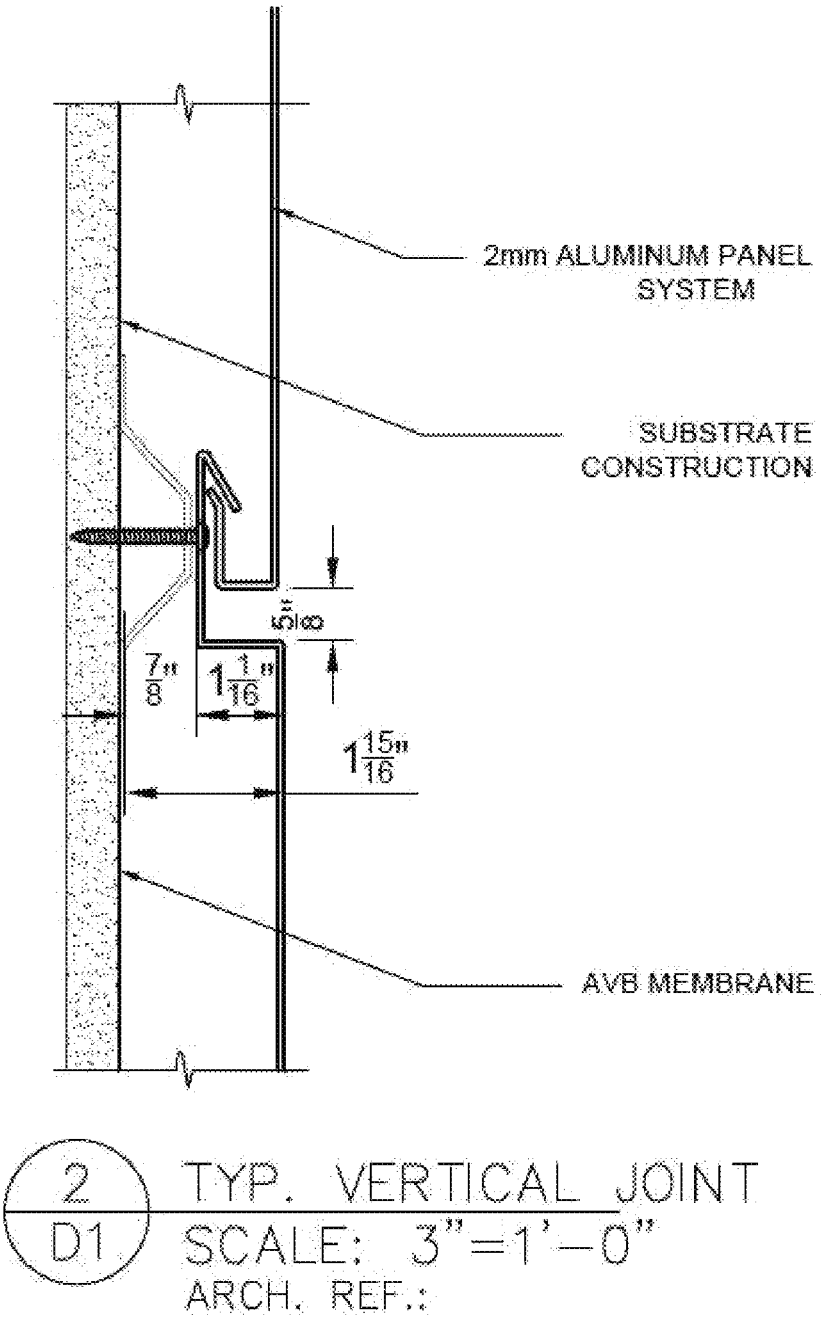
FIG. 15 is a schematic diagram showing an installation of one or more panels, according to some embodiments.
Figure 16:
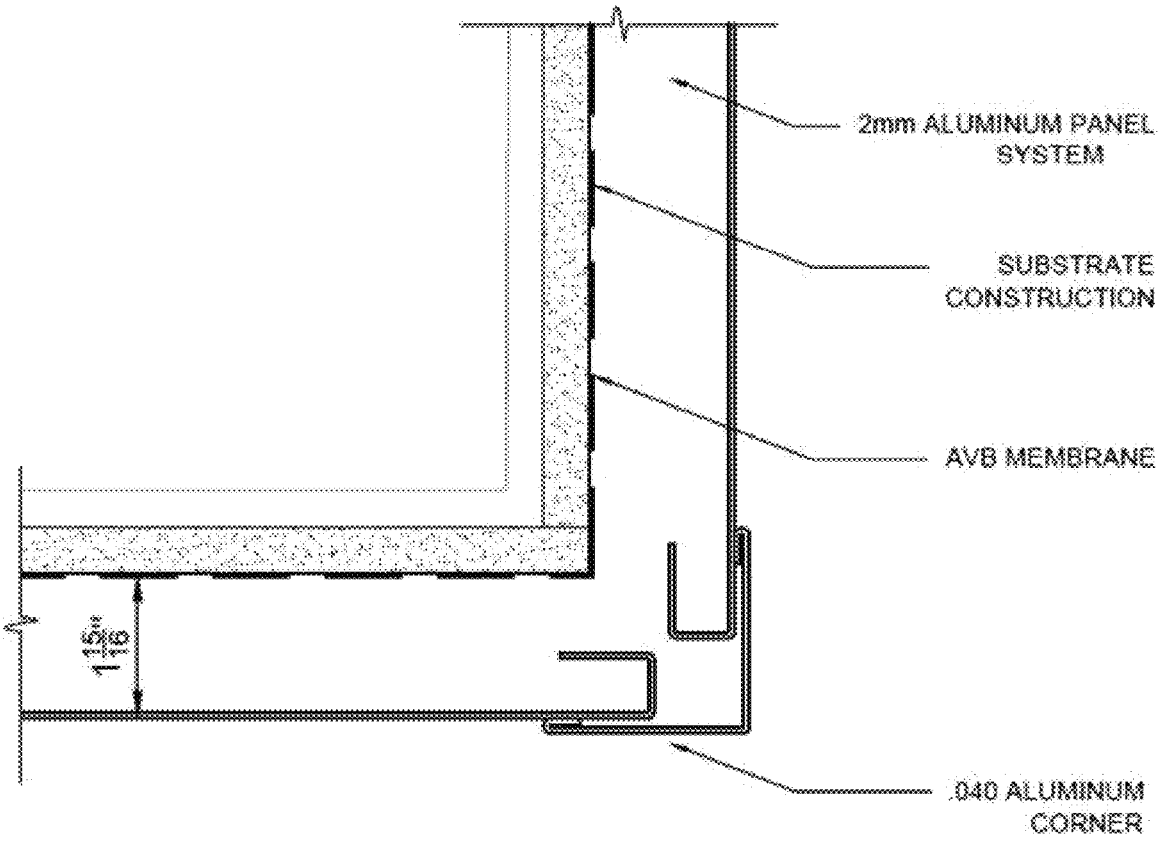
FIG. 16 is a schematic diagram showing an installation of one or more panels, according to some embodiments.
Figure 17:
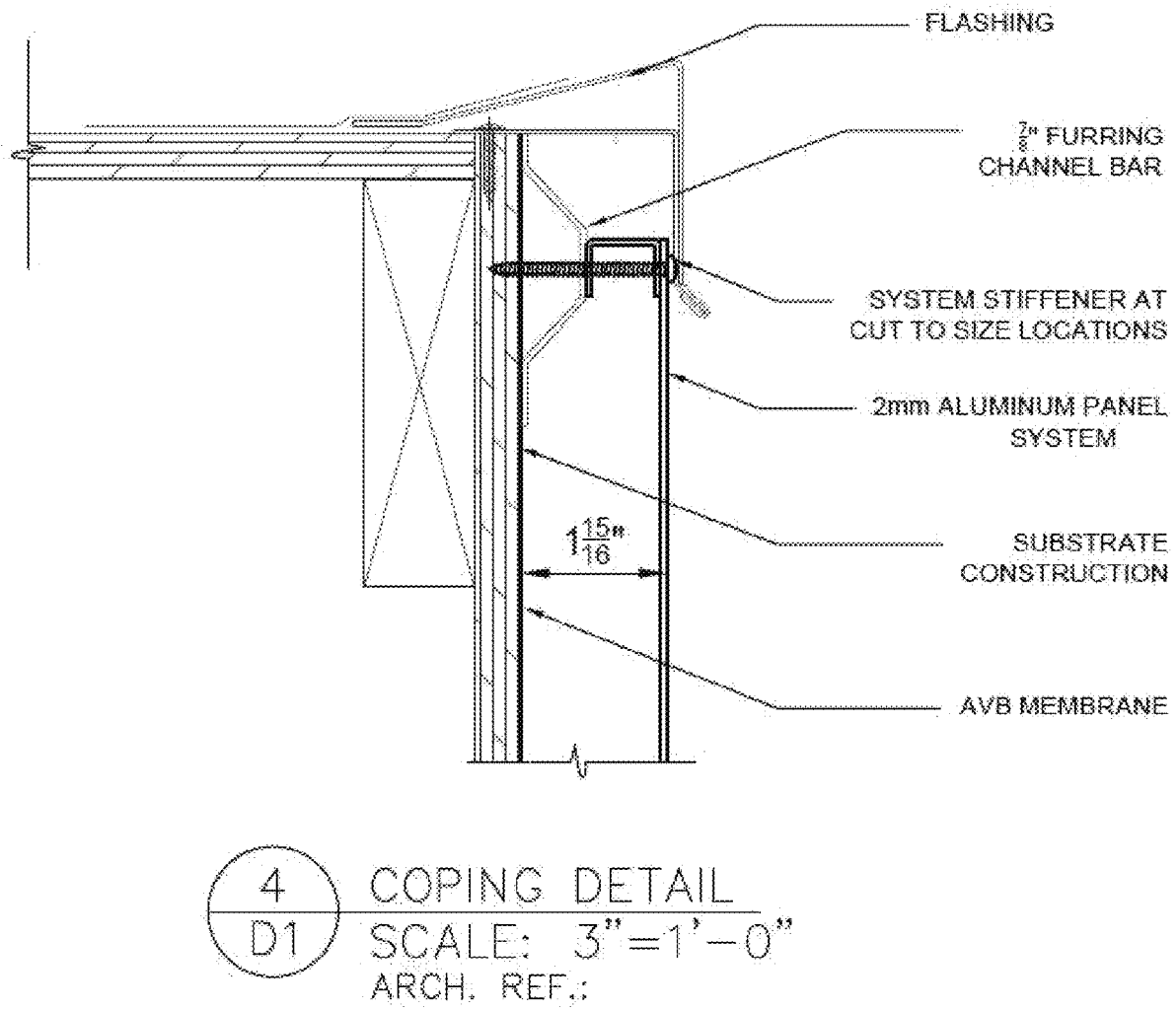
FIG. 17 is a schematic diagram showing an installation of one or more panels, according to some embodiments.
Figure 18:
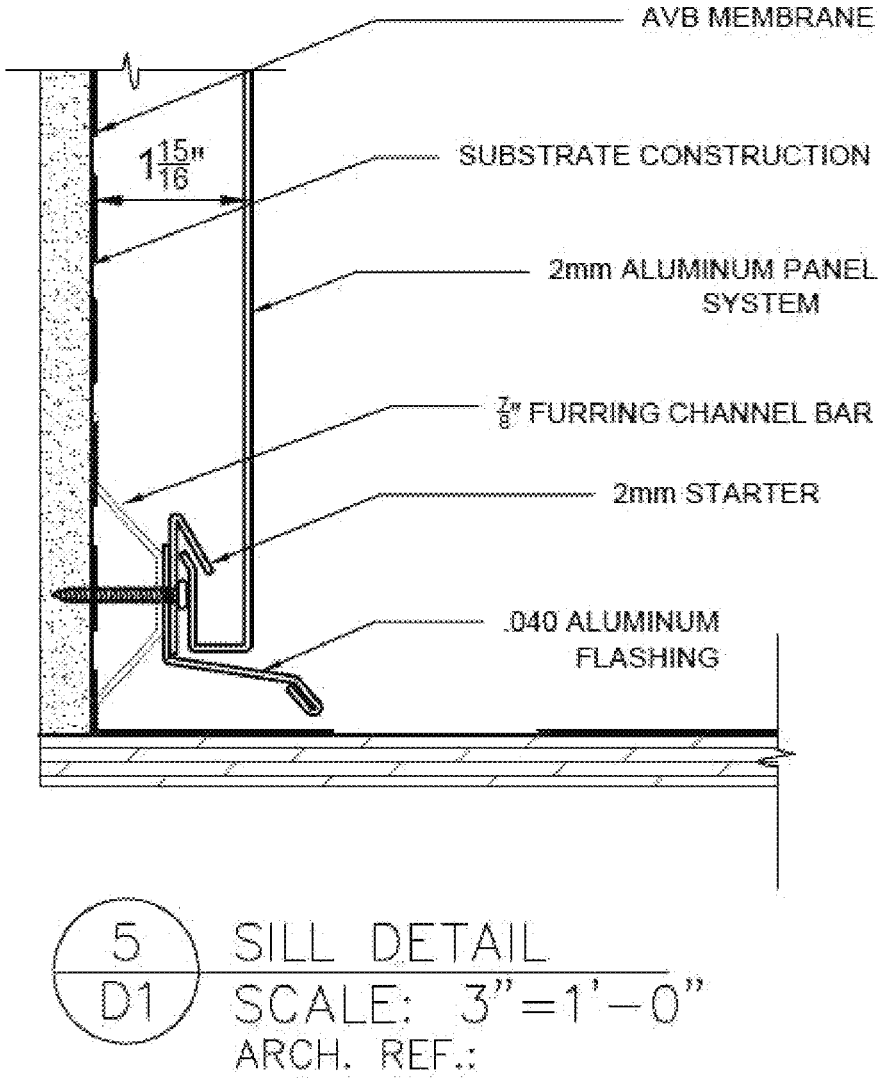
FIG. 18 is a schematic diagram showing an installation of one or more panels, according to some embodiments.
Figure 19:
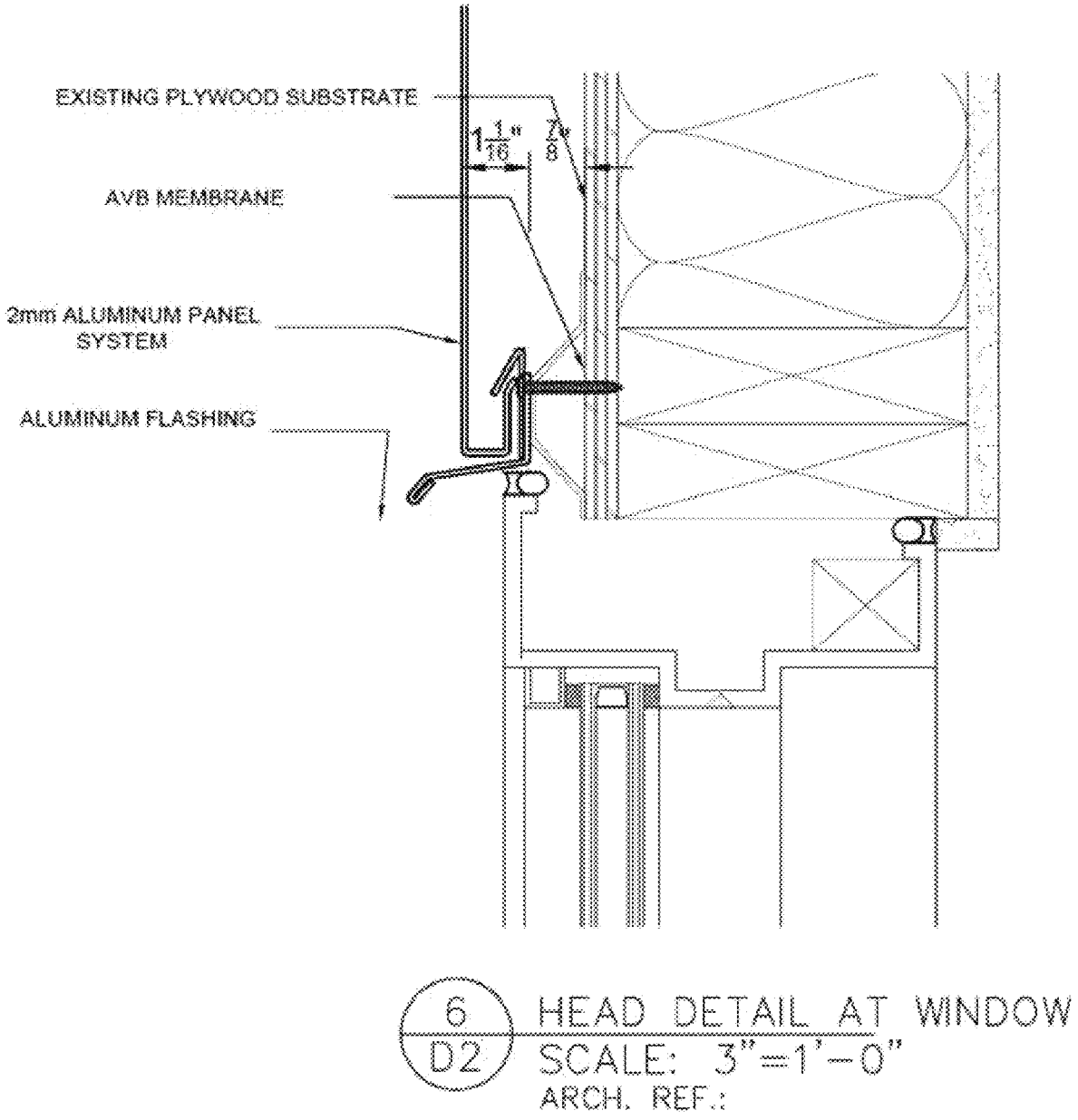
FIG. 19 is a schematic diagram showing an installation of one or more panels, according to some embodiments.
Figure 20:
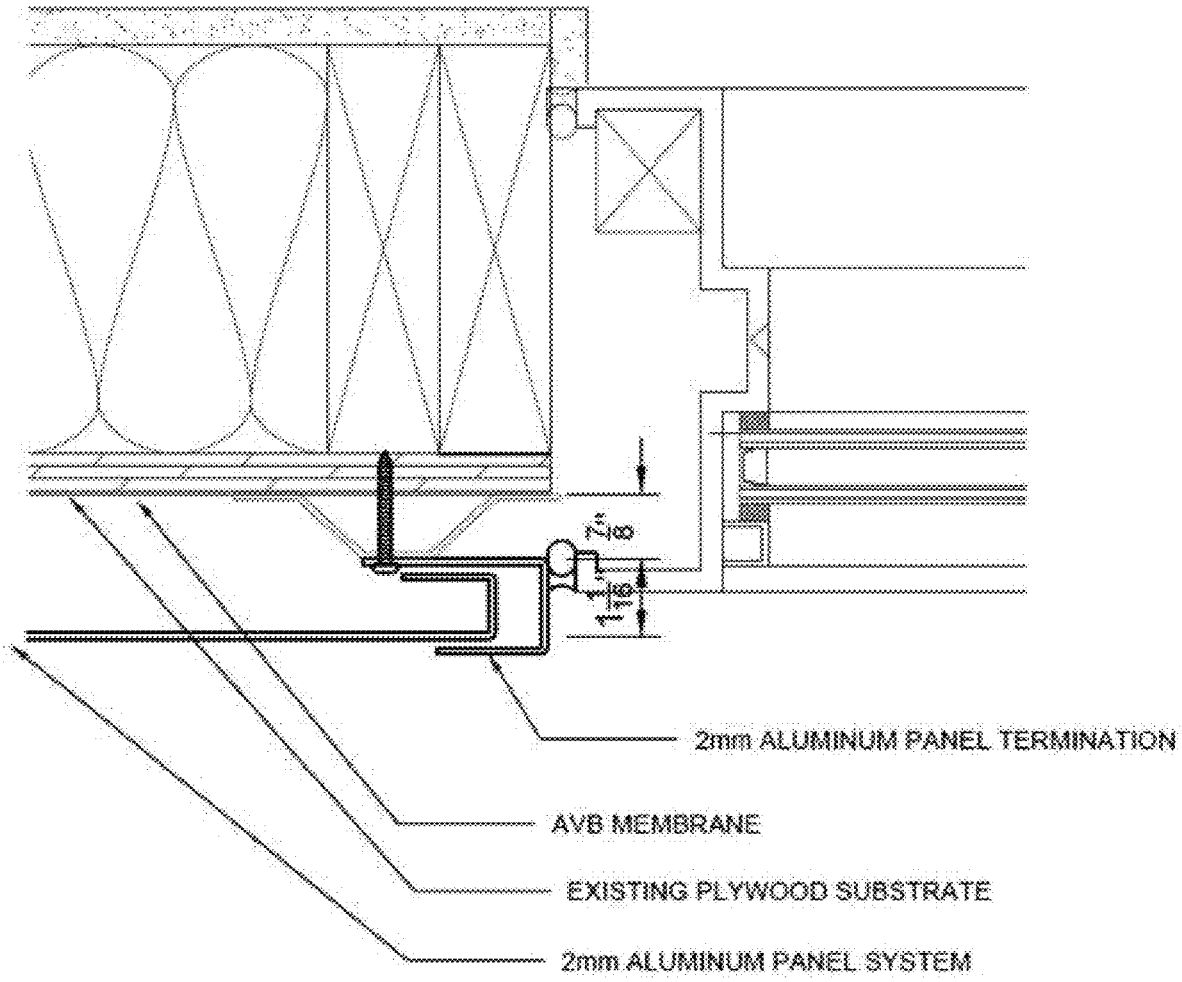
FIG. 20 is a schematic diagram showing an installation of one or more panels, according to some embodiments.
Figure 21:
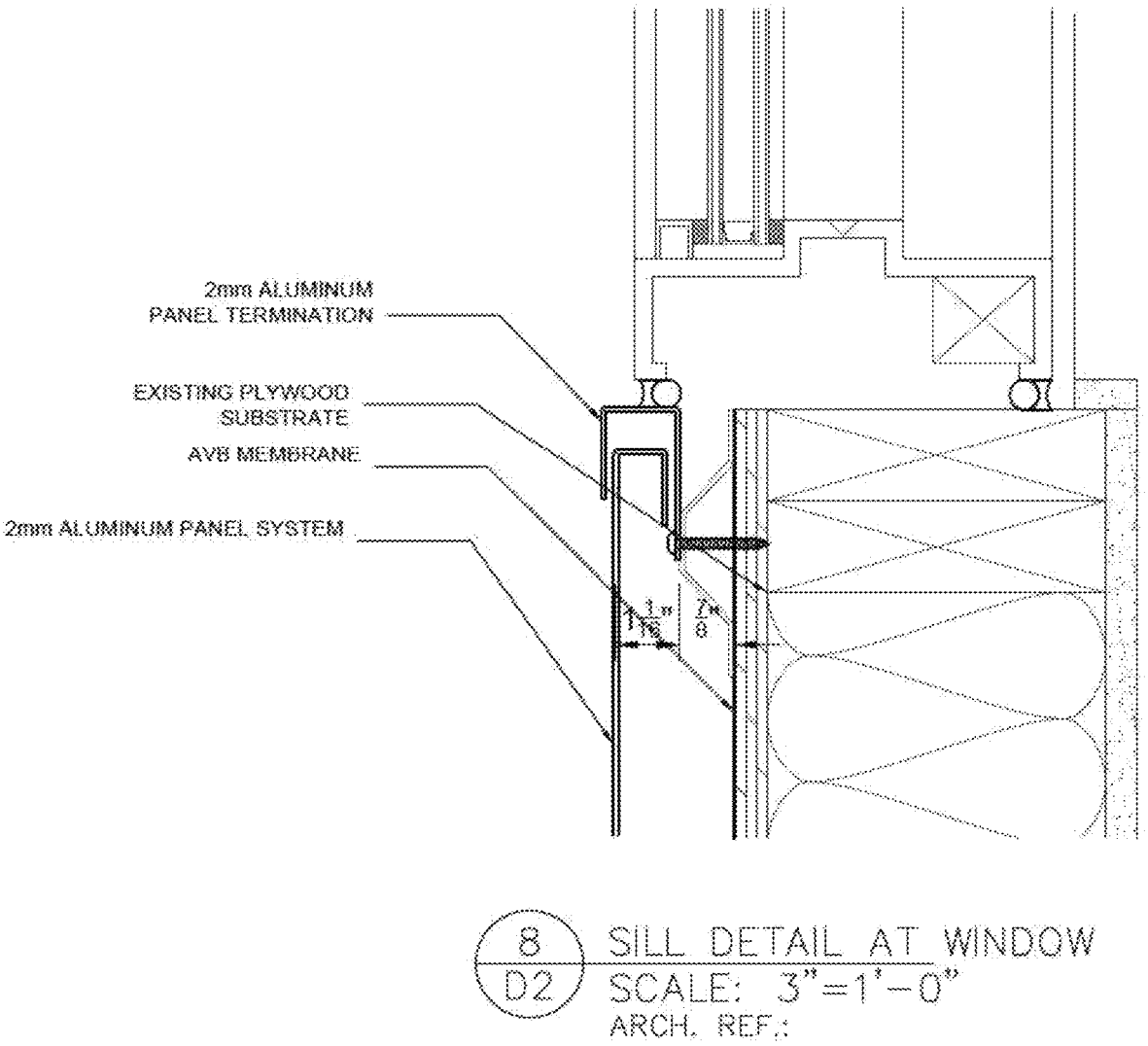
FIG. 21 is a schematic diagram showing an installation of one or more panels, according to some embodiments.

FIGS. 7A, 7B, 7C, and 7D are schematic diagrams showing example devices for installation of one or more panels according to some embodiments. FIG. 7A shows an example screw. The screw can be a #10 S.S. TEK screw 1½ inches long (e.g., measured from under the head to the tip)

and can be used for attachment of a clip to a Z-grit. FIG. 7B shows an example starter track. The starter track can be 2 mm thick and made from pre-painted aluminum, for example. Members of the starter track can be measured ⅞ inches and 2⅝ inches, for example. FIG. 7C shows an example J-channel. The J-channel can be 120 inches long, 0.040 mm or 2 mm thick, and made from pre-painted aluminum, for example. Members of the J-channel can be measured 2½ inches, 1¼ inches, and 1½ inches, for example. FIG. 7E shows an example corner. The corner can be 120 inches long 0.040 mm or 2 mm thick, and made from pre-painted aluminum, for example. Members of the corner can be each 2¾ inches, for example. Other measurements and dimensions are possible.

Example installation configurations of one or more panels 100 are shown in FIGS. 14, 15, 16, 17, 18, 19, 20, and 21, according to some embodiments. Other measurements, sizes, distances, materials, and configurations are possible, and the embodiments shown in the figures are examples only. One or more panels 100 can be installed at a substrate using various attachment devices for attachment to the wall such as shown in these figures. For example, a panel 100 can be installed at a wall as cladding or P.E.R. cladding. Multiple panels 100 can be installed in relation to each other as described herein, such as without using additional devices for securing a panel to an adjacent panel. FIG. 8A, 8B, 8C, 9A, 9B, 9C, 10A, 10B, 10C, 11A, 11B, 11C, 12A, 12B, 12C, 13A, 13B, and 13C are schematic diagrams showing example side elevation, front elevation, and side elevation views of example installations of panels 100 at a substrate such as a wall, according to some embodiments. In some embodiments, multiple sized modules and/or panels 100 can be used together at installation such as at a wall. For example, installation at a wall can use modules or panels 100 of 2'×4' with the next row being (a) 12"×96" panel(s). This can enable creation or use of variable heights and widths of a panel system using different sized modules or panels together. This can be achieved while the interlocking connection and reveal face remaining as described herein, according to some embodiments.

Figure 6A:
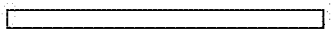
FIG. 6A is a schematic diagram of a panel, according to some embodiments.
Figure 6B:
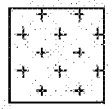
FIG. 6B is a schematic diagram of a panel, according to some embodiments.
Figure 6C:
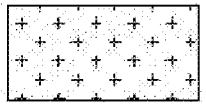
FIG. 6C is a schematic diagram of a panel, according to some embodiments.
Figure 6D:
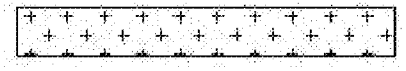
FIG. 6D is a schematic diagram of a panel, according to some embodiments.
Figure 6E:
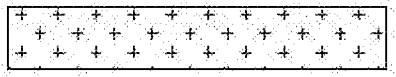
FIG. 6E is a schematic diagram of a panel, according to some embodiments.

FIGS. 6A, 6B, 6C, 6D, and 6E are top and front schematic views of example panels 100, according to some embodiments. FIG. 6A shows a top view of an aluminum panel. The aluminum panel can be 2 mm thick, for example. FIGS. 6B to 6E show example panels having sizes such as 24 inches by 24 inches, 24 inches by 48 inches, 12 inches by 96 inches, and 16 inches by 96 inches. Other panel 100 sizes are possible. Various sizes, dimensions, thicknesses, and shapes are possible in addition to others not shown. For example, a panel 100, as defined by the exterior face 110 can be square or rectangular.

In some embodiments, panel 100 and assembled panel systems provide a panelized, non-combustible, exterior, metal cladding, comprising a single component (e.g., panel 100) that can be installed in a commercial or residential P.E.R. building envelope. In some embodiments, panel 100 and assembled panel systems provide improvements including that panels 100 are not made out of rolled steel or aluminum siding that cannot act as a P.E.R. or aluminum composite material (ACM), as steel can limited installation to a linear install design, ACM material may require many installed components and can be combustible, and aluminum plate material may require many installed components and not be compatible with a single-component design. In some embodiments, panel 100 and assembled panel systems provide improvements including by providing a modular panel system that does not include any other installed components apart from panels 100, a truly panelized design with a single component, reduced combustibility, engineering that can be used for a wide variety of applications without requiring extensive customization, and a modular design. In some embodiments, panel 100 and assembled panel systems provide a pre-engineered modular true panelized system having a flush reveal plane, eliminate multiple components, enable a one component install, and/or are non-combustible. In some embodiments, advantages over other technology include efficiency of installation without requiring accessory clips or installation accessories and that the reveal plane is flush and consistent with no multiple layers or folds within the reveal face. In some embodiments, panel 100 and assembled panel systems provide features such as an interlock system that can allow for a one component design and installation, where the interlock system incorporates a fold design that allows for a consistent flush reveal plane; alignment tabs that maintain a square, plumb, and level installation; and a one component or modular design that can allow for efficient installation.

Figure 4:
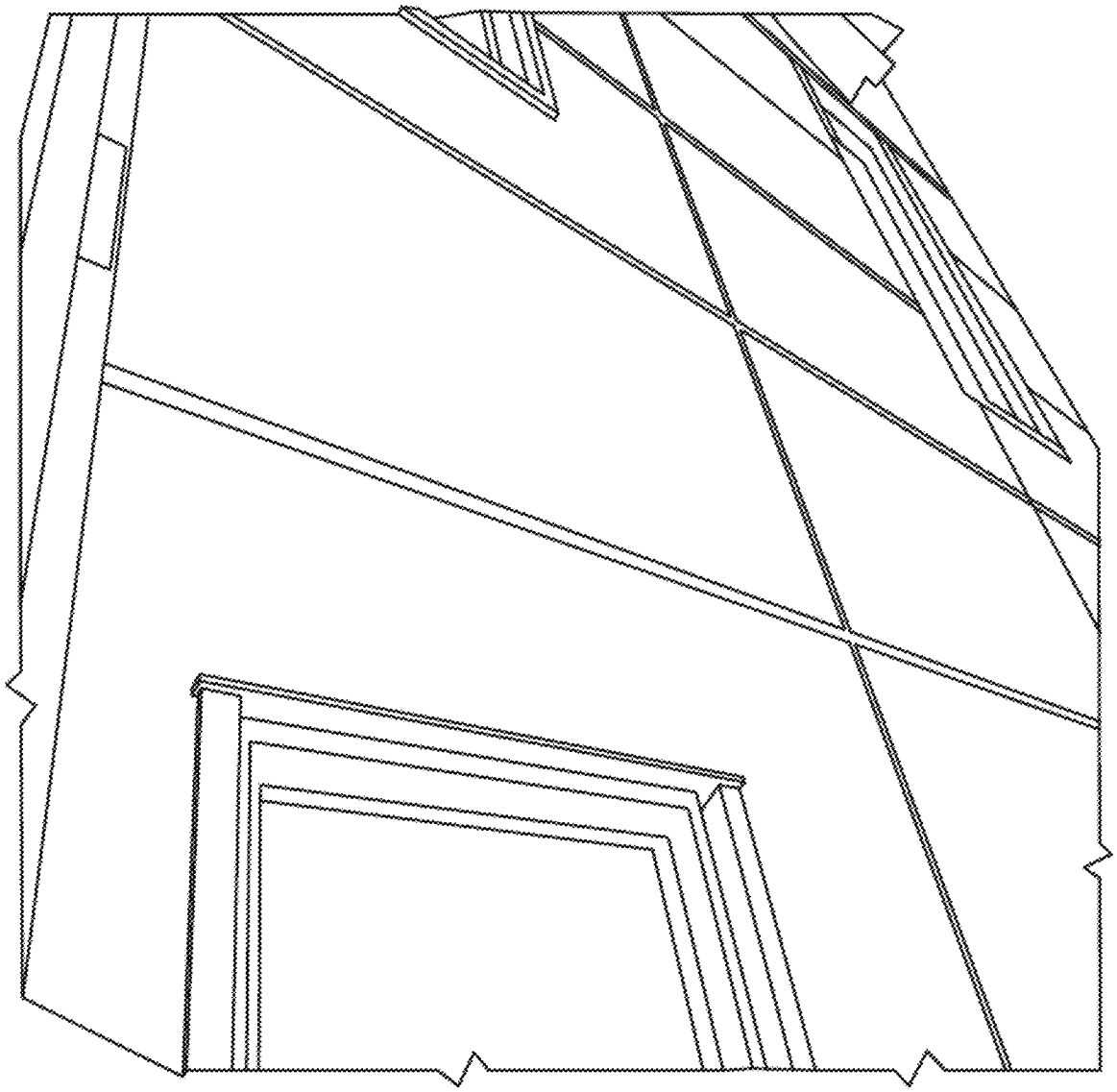
FIG. 4 is a schematic view of an installation of a panel system, according to some embodiments.
Figure 5:
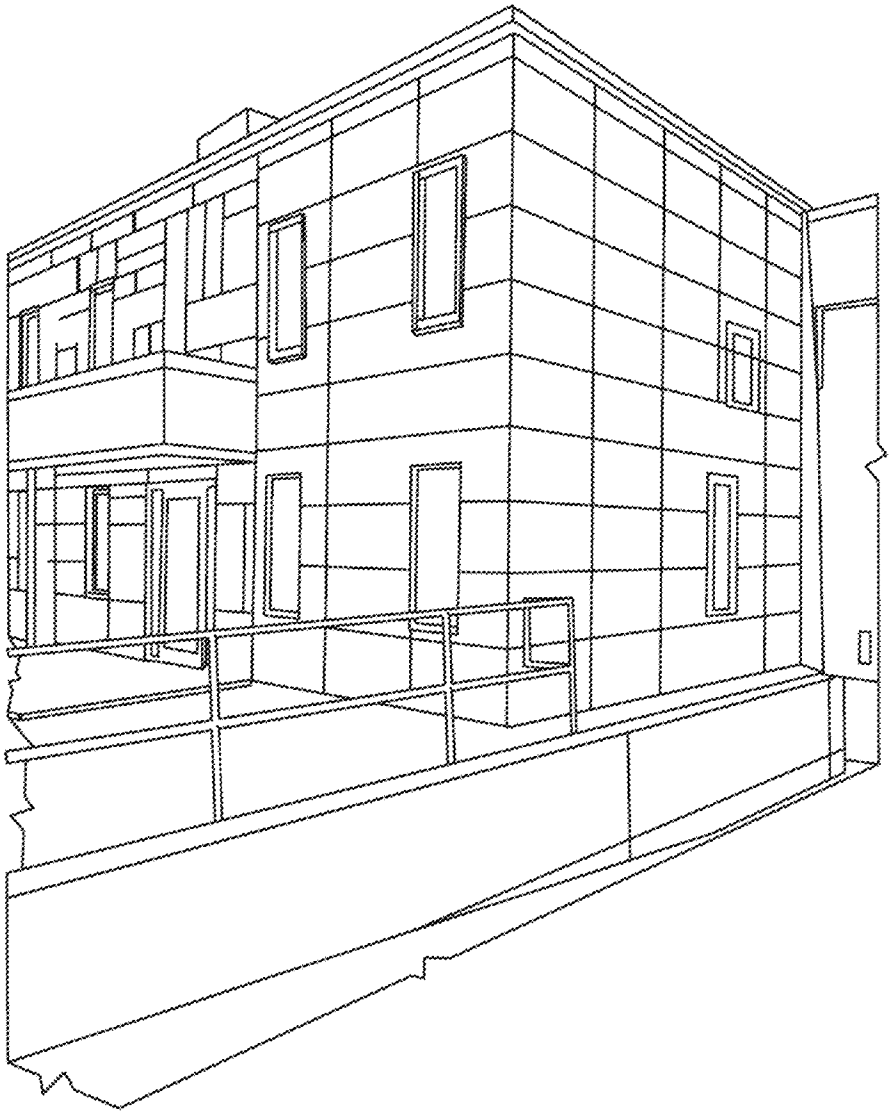
FIG. 5 is a schematic view of an installation of a panel system, according to some embodiments.

FIGS. 4 and 5 are diagrams showing an assembled panel system according to some embodiments. In some embodiments, the panel system provides a panelized metal cladding P.E.R. using a single component. As shown, in some embodiments, its modular design allows for efficient and simple installation as well as using a minimum of materials. Embodiments described herein provide a simple design and a unique interlock and consistent reveal plane design that creates an aesthetically clean and modern finish while dramatically managing moisture in a vastly superior way to other technologies.

In some embodiments, on assembly, the exterior face 120 can form an outward facing portion of the panel 100. For example, in some embodiments, panel 100 is assembled along a vertical building wall with exterior face 120 facing away from the wall. The exterior face 120 forms an exterior most portion of panel 100 as measured from a plane formed by a wall on assembly. For example, the exterior face 120 defines a plane that is a distance away from a plane defined along the reveal face 110. On assembly, the reveal face 110 can be positioned parallel to a wall (e.g., abutting the wall), while the exterior face 120 protrudes a distance from the wall that is greater than any distance between the reveal face 110 and the wall.

Figure 22:
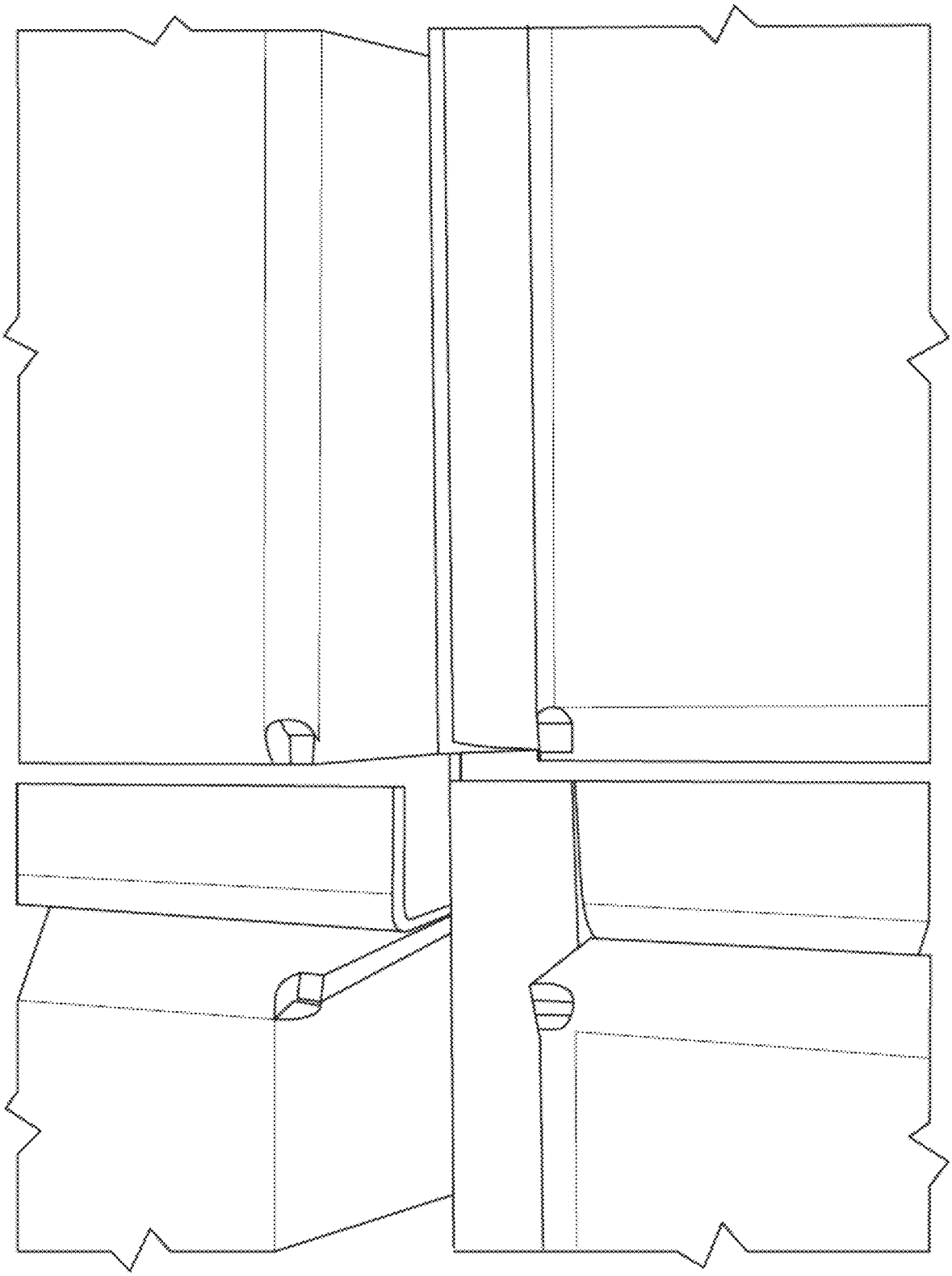
FIG. 22 is a photograph of an example alternative design.
Figure 23:
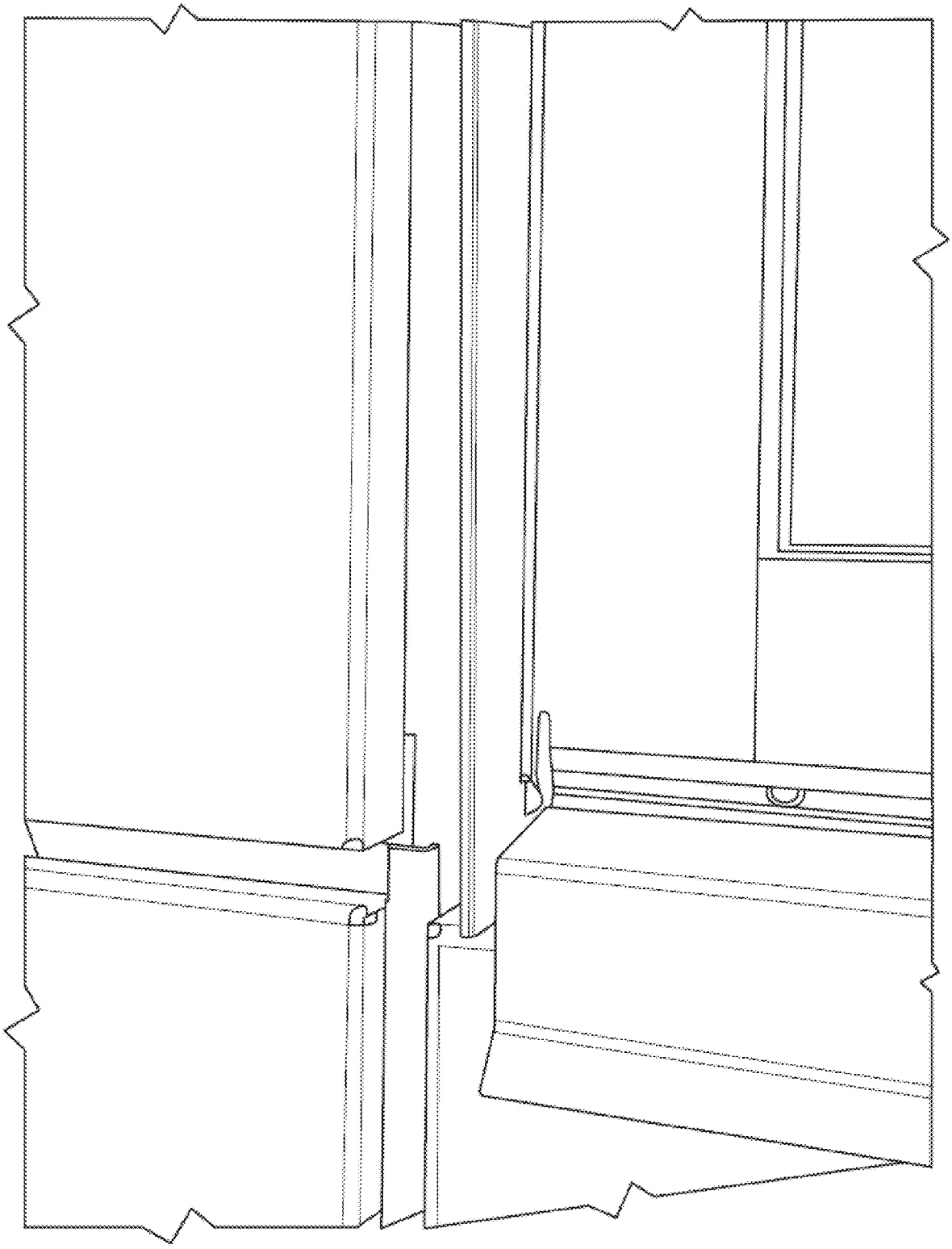
FIG. 23 is a photograph of an example alternative design.

FIGS. 22 and 23 are diagrams showing an alternative technology. Embodiments described herein provide differences from the technology shown in FIGS. 22 and 23 such as in relation to the reveal plane. For example, the attachment for the technology shown in FIGS. 6 and 23 happens within the reveal plane and happens at the base of the panel. This requires a channel fold within the product that is seen in the reveal plane. This makes for an aesthetically odd appearance and creates considerable trouble in draining water from the system.

The technology in FIG. 23 can be compared with embodiments as shown in FIG. 4 to illustrate the differences in the transition from each respective panel to the window.

Figure 24:
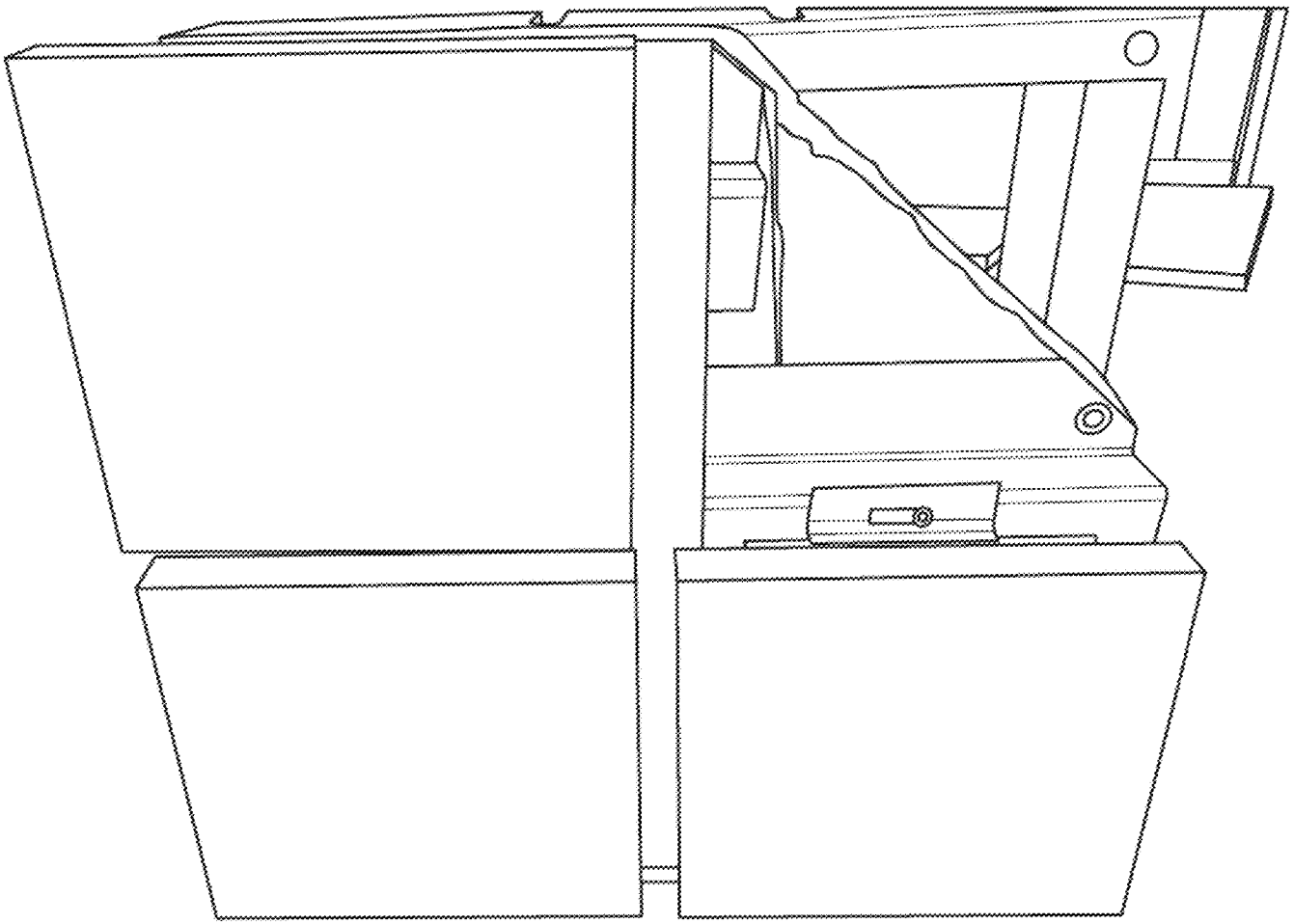
FIG. 24 is a photograph of an example alternative design.
Figure 25:
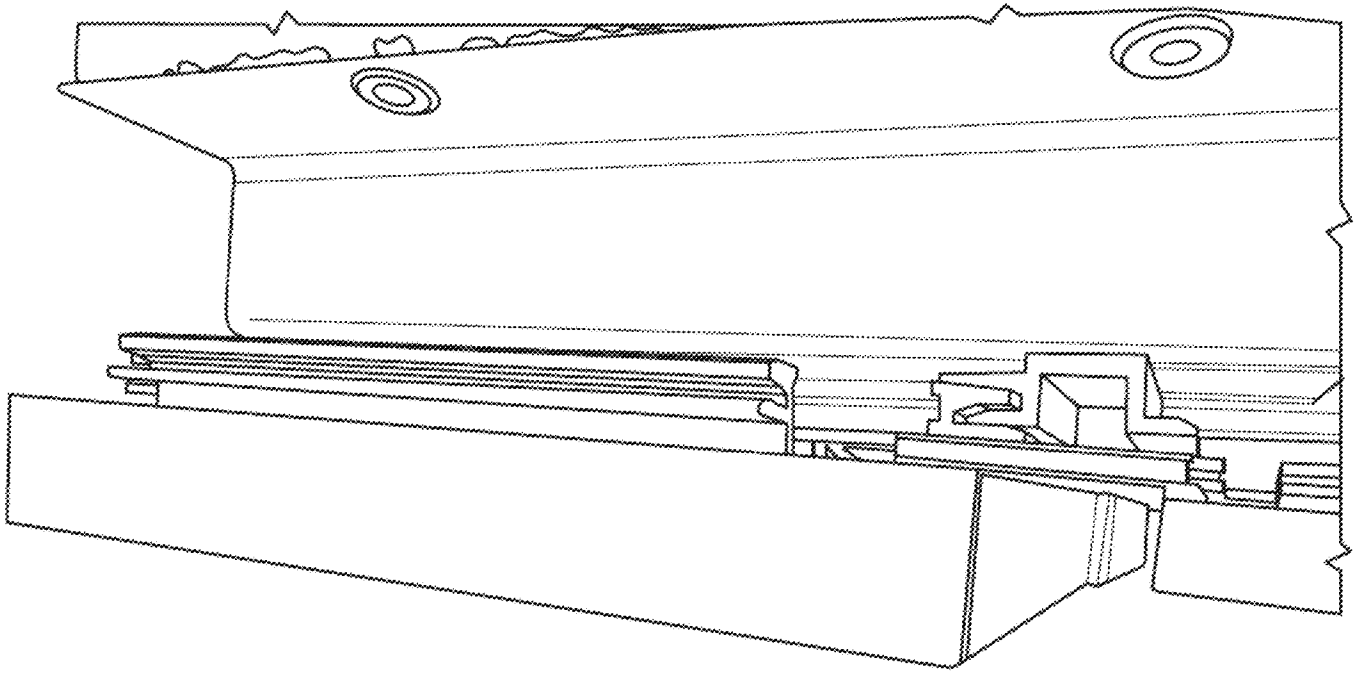
FIG. 25 is a photograph of an example alternative design.

FIGS. 24 and 25 are diagrams showing another alternative technology. Embodiments described herein provide differences from the technology shown in FIGS. 24 and 25 such as that in the alternative technology, multiple components such as an attached extrusion bar to the panel are used, as well as an installation bracket for attaching mounting screws and then the accessory concealed filler strip that conceals the reveal gap. The material of the technology shown in FIGS. 24 and 25 is also combustible.

Figure 26:
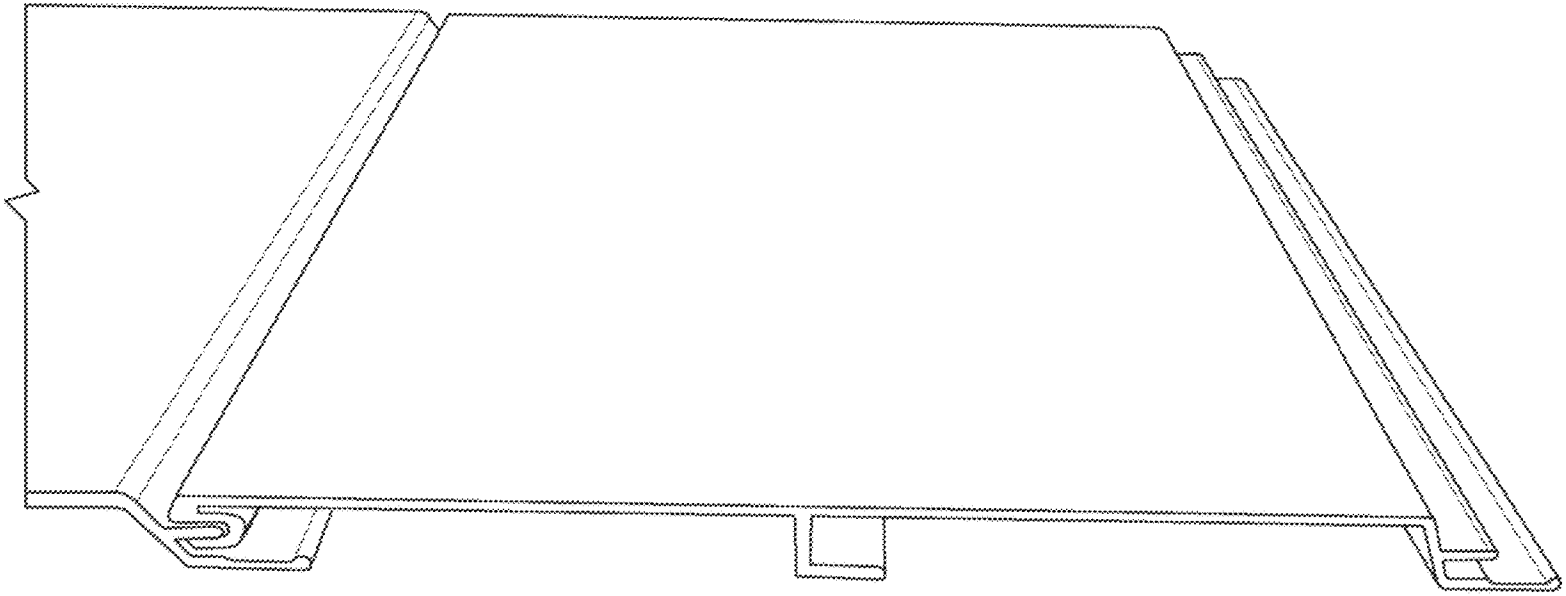
FIG. 26 is a photograph of an example alternative design.

FIG. 26 is a diagram showing another alternative technology. Embodiments described herein provide differences from the technology shown in FIG. 26 such as that the alternative technology provides a siding material that may be a single component system but that does not provide a panelized look that also facilitates improved water drainage and cannot act as a P.E.R.

Figure 27:
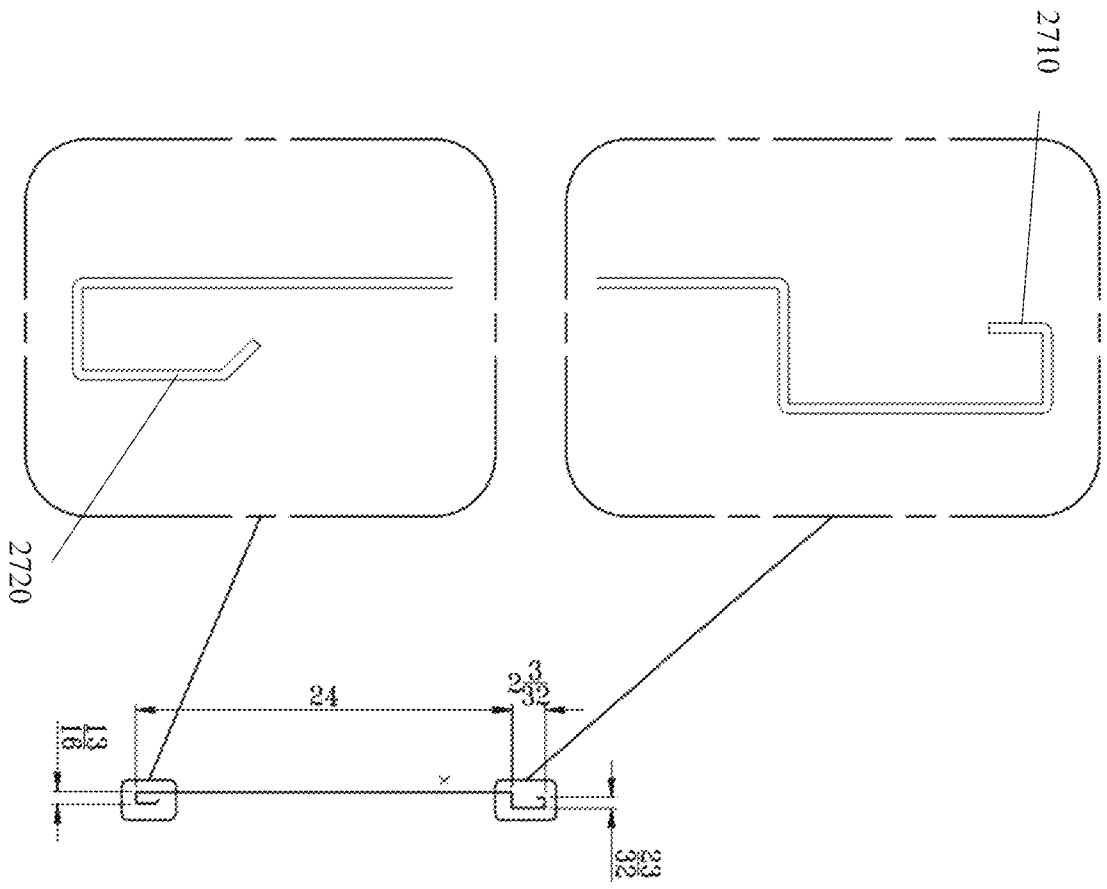
FIG. 27 is a schematic diagram showing a panel, according to some embodiments.
Figure 28:
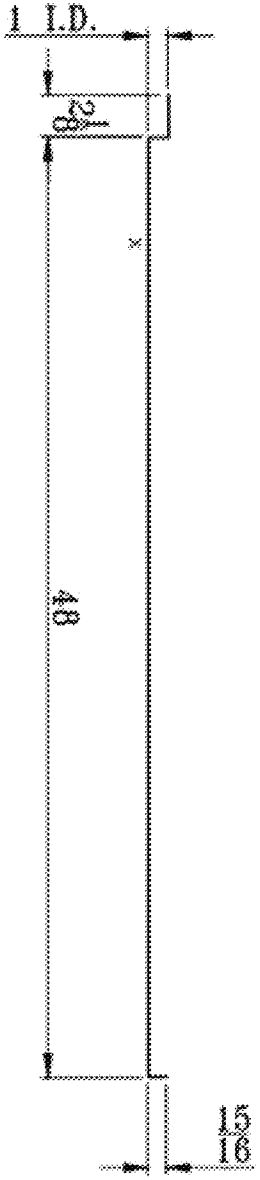
FIG. 28 is a schematic diagram showing a panel, according to some embodiments.
Figure 29:
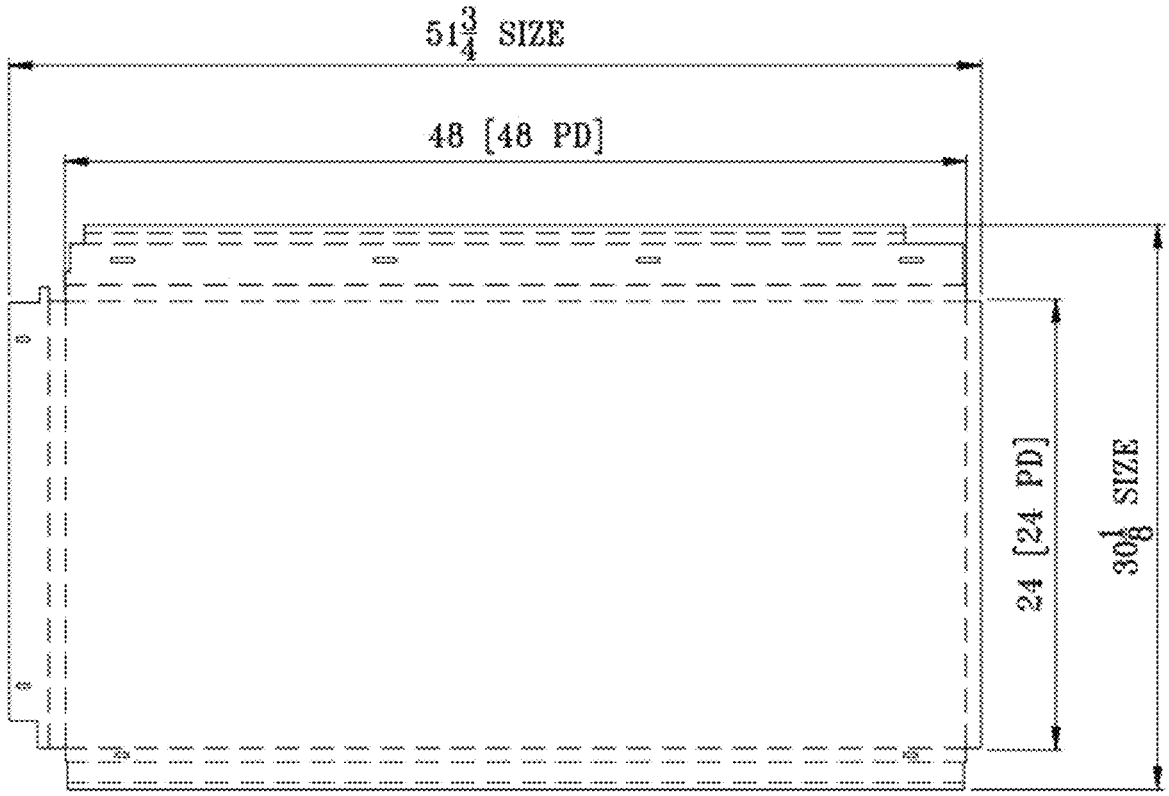
FIG. 29 is a schematic diagram showing a panel, according to some embodiments.

FIGS. 27, 28, and 29 are schematic diagrams showing example panels having an alternate interlocking connection, according to some embodiments. Interlocking connection 2710 of a panel is configured to engage with interlocking connection 2720 of an adjacent panel. This can form an interlocking assembly, according to some embodiments. Interlocking connections 2710, 2720 are shaped as complementary protrusions, as shown. Interlocking connection 2710 can be a top interlocking connection of a panel, while interlocking connection 2720 can be a bottom interlocking connection of the panel. In some embodiments, interlocking connections 2720, 2720 are shaped differently than shown. The shape and/or mechanics of engagement between complementary interlocking connections 2710, 2720 are selected to facilitate engagement between particular panels, support of adjacent panels, and/or integrity of an assembled panel system, according to various embodiments. Panels in an assembled panel system have interlocking connections 2710, 2720 as shown. This configuration can be used for lighter gauge metal sheets, for example, to help reduce or negating the effects of oil canning on the face of the panel for lighter gauge materials. An example panel has the dimensions shown in FIG. 27.

In some embodiments, a panel as shown in FIG. 27 can help reduce oil canning of the panel face in light gauge material. In some embodiments, a panel as shown in FIG. 28 can help reduce oil canning of the panel face in light gauge material. An example panel of some embodiments is shown in FIG. 29 as a plan view of a flat panel shape before bending or assembly of the panel.

FIG. 28 shows a plan view of a panel having example dimensions, according to some embodiments. FIG. 29 shows a schematic view of a panel having example dimensions and features, according to some embodiments.

According to an example embodiment, a panel includes an exterior face and a reveal face. The reveal face includes a top reveal plane extending at a top edge of the exterior face; and a side reveal plane extending at a side edge of the exterior face, the side reveal plane having a top alignment tab at a top end of the side reveal plane and a bottom alignment tab at a bottom end of the side reveal plane. The exterior face is elevated from the reveal face. The panel further includes a top protrusion extending from the top reveal plane; and a bottom protrusion extending at a bottom edge of the exterior face. In some embodiments, the panel can be configured similarly to that shown in FIG. 3, excluding the textual descriptions shown, but with panel 100, exterior face 120, reveal face including top reveal plane 110*a* and side reveal plane 110*b*, top alignment tab 130*a*, bottom alignment tab 130*b*, top protrusion 150, and bottom protrusion 140.

According to some embodiments, the top alignment tab extends beyond an axis defined by the top edge of the exterior face and the bottom alignment tab extending toward an axis defined by the bottom edge of the exterior face.

According to some embodiments, the top alignment tab abuts a bottom portion of the top reveal plane.

According to some embodiments, the top protrusion extends from the top reveal plane at an angle toward the exterior face, the top protrusion connected to the top reveal plane along a portion of a top edge of the top reveal plane. The top protrusion can be configured as shown by 150 in FIG. 1.

According to some embodiments, the bottom protrusion is an interior lip extending behind the exterior face. The interior lip can be configured as shown by 140 in FIG. 3.

According to some embodiments, the top protrusion extends orthogonally from the top reveal plane toward a first plane defined by the exterior face and then extending along a second plane, the second plane parallel to the top reveal plane. The top protrusion can be configured as shown by 2710 in FIG. 27.

According to some embodiments, the bottom protrusion extends orthogonally away from the exterior face, then extending along a third plane, the third plane parallel to the first plane, and then extending at a less than 90 degree angle toward the first plane. The bottom protrusion can be configured as shown by 2720 in FIG. 27.

According to some embodiments, the top protrusion is a hook-shape complementary to the bottom protrusion for engagement with the bottom protrusion of a second panel and support of the second panel at the bottom protrusion of the second panel. An example hook-shape is shown by 2710 in FIG. 27, with an example complementary bottom protrusion shown by 2720.

According to some embodiments, a panel system constructed using the panel includes a first panel connected to a second panel at an interlocking assembly, a first exterior face of the first panel spaced from a second exterior face of the second panel and from a third exterior face of the third panel.

According to some embodiments, the first panel has an alignment tab abutting a portion of a third panel.

According to some embodiments, the alignment tab abuts the third panel at a top reveal plane, the top reveal plane extending at a top edge of the third exterior face, and the alignment tab abutting a second alignment tab of a side reveal plane of the second panel, the side reveal plane extending at a side edge of the second panel.

According to some embodiments, the second panel is supportable at a wall by the first panel without using an accessory, such as those that attach to a panel for fastening, for example, nails, screws, or clamps.

According to some embodiments, the spacing is at a reveal face, the reveal face flush between the first exterior face and second exterior face and the third exterior face.

According to some embodiments, the interlocking assembly is a bottom protrusion extending at a bottom edge of the first panel behind the first panel; and a top protrusion extending at a top edge of the second panel at an angle toward the second exterior face.

According to some embodiments, the top protrusion is hook-shaped and complementary to the bottom protrusion for engagement with the bottom protrusion of a second panel and support of the second panel at the bottom protrusion of the second panel.

According to some embodiments, a method for assembly of a panel system includes abutting an alignment tab of a first panel with a reveal plane of a second panel; and interlocking the first panel with a third panel at an interlocking assembly.

According to some embodiments, the interlocking further includes supporting the third panel by hooking a top portion of the third panel with a bottom portion of the first panel.

According to some embodiments, the hooking further includes mechanically impeding movement of the third panel away from the first panel in at least one direction.

According to some embodiments, the method further includes directing water drainage over the reveal plane of the second panel or over a reveal plane between the first panel and the third panel.

According to some embodiments, the method further includes interlocking a fourth panel with the second panel at a second interlocking assembly.

The described implementations herein of the present disclosure are intended to be examples only. Alterations, modifications, and variations may be effected to the particular implementations without departing from the scope of the disclosure.

Certain adaptations and modifications of the present disclosure are contemplated. Therefore, the presently discussed embodiments are considered to be illustrative and not restrictive.

While the foregoing provides certain non-limiting example embodiments, it should be understood that combinations, subsets, and variations of the foregoing are contemplated.

What is claimed is:

1. A panel, comprising:

an exterior face;

a reveal face, comprising:

a top reveal plane extending at a top edge of the exterior face; and a side reveal plane extending at a side edge of the exterior face, the side reveal plane having a top alignment tab at a top end of the side reveal plane and a bottom alignment tab at a bottom end of the side reveal plane, the top alignment tab and bottom alignment tab extending from the side edge of the exterior face parallel to the side reveal plane and extending from the side edge less than the side reveal plane;

the exterior face elevated from the reveal face;

a top protrusion extending from the top reveal plane; and a bottom protrusion extending at a bottom edge of the exterior face.

2. The panel of claim 1, the top alignment tab extending beyond an axis defined by the top edge of the exterior face and the bottom alignment tab extending toward an axis defined by the bottom edge of the exterior face.

3. The panel of claim 2, the top alignment tab abutting a bottom portion of the top reveal plane.

4. The panel of claim 1, the top protrusion extending from the top reveal plane at an angle toward the exterior face, the top protrusion connected to the top reveal plane along a portion of a top edge of the top reveal plane.

5. The panel of claim 1, the bottom protrusion being an interior lip extending behind the exterior face.

6. The panel of claim 1, the top protrusion extending orthogonally from the top reveal plane toward a first plane defined by the exterior face and then extending along a second plane, the second plane parallel to the top reveal plane.

7. The panel of claim 6, the bottom protrusion extending orthogonally away from the exterior face, then extending along a third plane, the third plane parallel to the first plane, and then extending at a less than 90 degree angle toward the first plane.

8. The panel of claim 1, the top protrusion being a hook-shape complementary to the bottom protrusion for engagement with the bottom protrusion of a second panel and support of the second panel at the bottom protrusion of the second panel.

9. The panel of claim 1, wherein the top protrusion extends from the top reveal plane from a central portion of the top reveal plane, leaving a gap between each side edge of the top protrusion and each side edge of the exterior face.

* * * * *